US007549202B2

(12) United States Patent
Taniguchi et al.

(10) Patent No.: US 7,549,202 B2
(45) Date of Patent: Jun. 23, 2009

(54) PRESSURIZED STEAM-JETTING NOZZLE, AND METHOD AND APPARATUS FOR PRODUCING NONWOVEN FABRIC USING THE NOZZLE

(75) Inventors: Masahiro Taniguchi, Tokyo (JP); Tomio Suzuki, Hiroshima (JP); Shinichi Shimizu, Aichi (JP)

(73) Assignee: Mitsubishi Rayon Engineering Co., Ltd., Tokyo (JP)

( * ) Notice: Subject to any disclaimer, the term of this patent is extended or adjusted under 35 U.S.C. 154(b) by 0 days.

(21) Appl. No.: 12/056,699

(22) Filed: Mar. 27, 2008

(65) Prior Publication Data

US 2008/0179431 A1 Jul. 31, 2008

Related U.S. Application Data

(62) Division of application No. 10/530,430, filed as application No. PCT/JP03/12545 on Sep. 30, 2003, now Pat. No. 7,395,588.

(30) Foreign Application Priority Data

Oct. 8, 2002 (JP) ..... 2002-295456
Jan. 14, 2003 (JP) ..... 2003-006192
Jul. 30, 2003 (JP) ..... 2003-283099

(51) Int. Cl.
*D04H 1/46* (2006.01)

(52) U.S. Cl. ..... 28/104; 28/167

(58) Field of Classification Search ..... 28/104, 28/105, 106, 167, 103, 271, 276, 281; 68/5 R, 68/6, 7, 5 A–5 D, 222, 200, 201, 205 R; 8/149.3, 8/149.2; 239/589, 590, 590.3, 590.5, 596, 239/597, 553, 553.3, 553.5, 556, 566, 568, 239/600, 601; 162/207, 290

See application file for complete search history.

(56) References Cited

U.S. PATENT DOCUMENTS 2,778,683 A * 1/1957 Gillis ..... 239/451
2,809,867 A * 10/1957 Dupasquier ..... 239/121
2,862,251 A * 12/1958 Kalwaites ..... 264/119
2,973,635 A * 3/1961 Speers ..... 68/5 R (Continued)

FOREIGN PATENT DOCUMENTS

| | | |
|---|---|---|
| EP | 1 069 222 A1 | 1/2001 |
| JP | 50-152067 | 12/1975 |
| JP | 51-133579 | 11/1976 |
| JP | 2-164357 | 6/1990 |
| JP | 7-310267 | 11/1995 |
| JP | 9-256254 | 9/1997 |
| JP | 2000-144564 | 5/2000 |
| WO | WO 95/06769 | 3/1995 |

*Primary Examiner*—Amy B Vanatta
(74) *Attorney, Agent, or Firm*—Oblon, Spivak, McClelland, Maier & Neustadt, P.C.

(57) ABSTRACT

The present invention relates to a nozzle suitable for jetting high pressure and high temperature steam, and a method and an apparatus for producing an entangled nonwoven fabric using the nozzle. According to the apparatus, a steam inlet side main conduit and a steam outlet side conduit are connected with both end parts of a tubular nozzle holder in a longitudinal direction provided integrally with nozzle members having a plurality of nozzle holes. A steam outlet side conduit is provided with an opening/closing valve and a trap conduit is branched from a conduit at an upstream side from the opening/closing valve. By opening the opening/closing valve, a rapid temperature rise of the nozzle holder can be enabled at a time of starting a production of a nonwoven fabric. Furthermore, even in the opening/closing valve is closed in a regular operation, drainage generated inside the nozzle holder can always be discharged to outside so that steam can be jetted stably and continuously, and thus a high quality entangled fiber nonwoven fabric can be produced continuously from the fiber web by the steam.

20 Claims, 17 Drawing Sheets

U.S. PATENT DOCUMENTS 3,010,179 A * 11/1961 Thal ..... 28/160
3,037,706 A * 6/1962 Dupasquier ..... 239/120
3,040,412 A * 6/1962 Russell ..... 28/104
3,042,576 A * 7/1962 Harmon et al. ..... 162/114
3,353,225 A 11/1967 Dodson, Jr. et al.
3,403,862 A * 10/1968 Dworjanyn ..... 239/566
3,458,905 A 8/1969 Dodson, Jr. et al.
3,613,999 A * 10/1971 Bentley et al. ..... 239/553.3
3,688,355 A * 9/1972 Okzaki et al. ..... 28/104
3,841,566 A * 10/1974 Wilford ..... 239/568
3,857,514 A * 12/1974 Clifton ..... 239/132
3,878,991 A * 4/1975 Sabadics et al. ..... 239/456
4,085,485 A * 4/1978 Brandon et al. ..... 28/104
4,323,760 A * 4/1982 Greenway et al. ..... 392/490
4,358,900 A * 11/1982 Dove ..... 34/568
5,042,722 A * 8/1991 Randall et al. ..... 239/553.5
5,674,581 A 10/1997 Marco et al.
5,778,501 A * 7/1998 You ..... 28/104
6,604,694 B1 * 8/2003 Kordas et al. ..... 239/398
6,962,296 B2 * 11/2005 Hamel et al. ..... 239/11
7,441,315 B2 * 10/2008 Munstermann ..... 28/104
2004/0103506 A1 * 6/2004 Fleissner ..... 28/104

* cited by examiner

PRESSURIZED STEAM-JETTING NOZZLE, AND METHOD AND APPARATUS FOR PRODUCING NONWOVEN FABRIC USING THE NOZZLE

CROSS-REFERENCE TO RELATED APPLICATIONS

This application is a Divisional of and claims the benefit of priority under 35 U.S.C. § 120 from U.S. Ser. No. 10/530,430, filed Apr. 6, 2005, which is a National Stage of International Application PCT/JP03/12545, filed Sep. 30, 2003. This application also claims the benefit of priority under 35 U.S.C. § 119 from Japanese priority documents 2002-295456 filed in Japan on Oct. 8, 2002, 2003-006192 filed in Japan on Jan. 14, 2003, and 2003-283099 filed in Japan on Jul. 30, 2003. The entire contents of each of the applications listed above is herein incorporated by reference.

TECHNICAL FIELD

The present invention relates to a fluid jetting nozzle for jetting pressurized steam flow, a production method for a fiber entangled nonwoven fabric using the same and a production apparatus therefor.

BACKGROUND ART

Conventionally, a technique for producing an entangled nonwoven fabric by entangling constituent fibers with each other by jetting a high pressure fluid flow to a fabric web has been known as it is disclosed in for example Japanese Patent Application Laid-Open (JP-A) No. 51-133579 (patent document 1), JP-A No. 9-256254 (patent document 2), JP-A No. 2000-144564 (patent document 3), or the like. However, as the high pressure fluid disclosed in the patent documents 1 to 3, a high pressure liquid is used mainly. According to a production of an entangled nonwoven fabric by jetting a high pressure liquid flow, not only a liquid scattering prevention equipment is required due to a large liquid use amount and a purifying process equipment is required for the large amount of the liquid at a time of discharging the liquid after the process, but also a drying equipment for the obtained nonwoven fabric and a gigantic thermal energy consumed therefor are required. Moreover, noise based on a liquid jetting operation is rampant so as to deteriorate a work environment.

On the other hand, for example, although use of high pressure steam in stead of the high pressure liquid is mentioned in the above-mentioned patent document 1 and patent document 3, it is not for actively entangling the fibers or it is adopted without a recognition of a difference between the liquid flow and the steam flow. As a result, according to the patent documents 1 and 3, a jetting nozzle of the same structure is used without especially distinguishing the liquid flow and the steam flow, and thus a specific disclosure is not at all provided for the nozzle structure in consideration to a behavior peculiar to the jetted steam or a steam supply mechanism or discharging mechanism.

In order to solve problems at a time of producing the fiber entangled nonwoven fabric by the high pressure liquid flow, for example, WO 95/06769 pamphlet (patent document 4), JP-A No. 7-310267 (patent document 5), and the patent document 2 proposes active use of the steam as the high pressure fluid at the time of producing a nonwoven fabric by the high pressure fluid flow. In a case the steam is used, compared with the water jetting method, the water use amount can drastically be reduced as well as the discharging process equipment therefor can be miniaturized so that the noise generation can be reduced so as to improve the work environment. Additionally, the drying device can be eliminated or miniaturized for realizing energy saving. Furthermore, generation of a pattern at an entangled parts appearing on a nonwoven fabric surface peculiar to the fiber entangled nonwoven fabric by the liquid flow can be alleviated.

According to a production method for the nonwoven fabric of the above-mentioned patent document 4, an end product (nonwoven fabric) is produced by providing a fiber having a melting point lower than a temperature of the steam or superheated steam as an entirety or a part of a constituent fiber for the fiber web, producing a cloth (nonwoven fabric) preliminarily by entangling the web constituent fiber by a liquid flow, then jetting the steam or the superheated steam from a cloth surface toward a cloth inside so as to melt and fuse a low melting point fiber in the web constituent fiber. Moreover, a web entangling method disclosed in the above-mentioned patent document 5 is for entangling the web fiber with each other by using the steam as the high pressure fluid. According to a production method for the nonwoven fabric disclosed in the above-mentioned patent document 2, the nonwoven fabric is produced by jetting directly the steam to the fiber web instead of the conventional high pressure jetting water so as to function with fog like water generated by a temperature drop at a time for entangling the web constituent fiber.

According to an analysis of a content of the above-mentioned patent document 4, although use of high temperature steam is mentioned, various conditions peculiar to the fiber entanglement by the steam such as a steam pressure at the time of jetting and a nozzle hole size, a shape, or the like, are not mentioned. From this aspect, it is understood that the production of the nonwoven fabric by for example a high temperature superheated steam flow disclosed in the patent document 4 aims mainly at melting the fiber web constituent fiber made of a thermally fusible material by the steam heat instead of entangling the fiber by its steam flow. In general, as it is disclosed for example in the above-mentioned patent document 3, the fiber entangled nonwoven fabric produced by jetting a high pressure water flow has a hitting trace or an open hole trace by the jetting fluid.

According to the production method for a nonwoven fabric of the above-mentioned patent document 4, fiber entangling by the jet water flow is executed as a pre-process for jetting the steam to the fiber web. Therefore, it is considered that naturally the hitting trace and open hole trace remain on the cloth with the fiber entangling by the jet water flow so that the high temperature steam jetted thereto passes mainly through the hitting trance and open hole trace without penetrating through in a thickness direction in a cloth entire surface. Of course, another low melting point fibers present on the web surface without formation of the hitting trace or open hole trace are molten at the same time. It is recognized from a fact that parts with the fibers fused with each other are present in a region without formation of the hitting trace or open hole trace in FIGS. 4 to 5 in the patent document 4. As a result, the nonwoven fabric shown in the figures is not different from the conventional nonwoven fabric produced by point bonding in terms of flexibility, and there are hardened parts by the thermally fusible material particularly on the surface.

Moreover, although a structure of an embodiment of a steam jetting nozzle is shown in a figure of the above-mentioned patent document 5, the structure, a size, a use embodiment, or the like of the jetting nozzle is not at all mentioned specifically.

On the other hand, although the above-mentioned patent document 2 discloses a specific structure of a steam jetting nozzle, how the steam is sent into the jetting nozzle and what kind of conditions are required to jet the high pressure steam evenly and continuously from the nozzle are not disclosed specifically. As the steam used for the jetting operation, in general, industrial water with a soft water process and a slight amount of an additive added is used. Furthermore, since it passes through various kinds of tubes, or the like, extremely fine foreign substances can be mixed in the steam so that the jetting nozzle holes can easily be choked. Or since a part of the steam introduced into the nozzle is condensed so as to be drainage and pooled in a vicinity of the nozzle hole, the nozzle hole can easily be choked and thus the steam can easily be jetted intermittently instead of jetted continuously. Furthermore, although the nozzle structure disclosed in the patent document 2 can be adopted preferably for a fluid flow jetting nozzle, a number of parts is too large so that it is too complicated for a steam jetting nozzle.

The present invention has been achieved for solving the above-mentioned problems, and an object thereof is to provide a pressurized steam jetting nozzle having a simple structure, capable of jetting pressurized steam evenly and continuously, obtaining a predetermined strength by certainly entangling a part or substantially the entirety of the constituent fibers of a fiber web, ensuring a surface flexibility of the nonwoven fabric to be obtained, and improving an internal embodiment thereof, an efficient production method for a nonwoven fabric capable of certainly entangling the constituent fibers of a fiber web by jetting pressurized steam using the nozzle, and a continuous production apparatus for a high quality fiber entangled nonwoven fabric by steam using the nozzle.

DISCLOSURE OF INVENTION

A basic configuration of a pressurized steam jetting nozzle according to the present invention is characterized by comprising a tubular nozzle holder having on one end a steam inlet opening to be connected with a pressurized steam supply tube, on another end a steam outlet opening to be connected with a steam discharge tube of an outside, and an opening elongating along a longitudinal direction of a lower surface, and a nozzle member disposed detachably on the lower surface of the nozzle holder, having a plurality of nozzle holes formed facing the opening.

Here, the most characteristic point is that the steam inlet opening is provided on one end of the nozzle holder and the steam outlet opening on the other end. The steam cannot be jetted from the pressurized steam jetting nozzle all the time. For example, at a time of a regular check up or at a time of stopping a machine, a steam supply is stopped as well. In a case a steam jetting operation is stopped accordingly, naturally temperature inside the nozzle is dropped drastically. In order to start a nonwoven fabric production by resuming the steam jetting operation, the temperature inside the pressurized steam jetting nozzle should be raised to a predetermined temperature. In a case parts other than the steam inlet opening is provided in a sealed state at a time of the temperature rise as in the conventional jetting nozzle, the steam amount to be introduced into the nozzle holder remains only to an amount to be jetted from the nozzle hole so that a long time is needed for raising the temperature of the nozzle itself due to a small calorie exchange amount.

Therefore, according to the present invention, as mentioned above, the steam outlet opening is provided on another end of the nozzle holder so that the steam outlet opening is provided switchably by mounting for example an opening/closing valve, or the like as it is to be described later to the steam discharge tube connected with the steam outlet opening. At present, before starting a drive of the nonwoven fabric producing apparatus, the steam is introduced into the nozzle holder. At the time, the steam outlet opening is opened so that the steam introduced from the steam inlet opening is discharged continuously to the outside through the steam outlet opening. The nozzle holder temperature is measured so that the steam outlet opening is closed at a time the temperature reaches at a predetermined temperature. Simultaneously with a closure, the steam pressure at the steam inlet opening is measured so that, at the time the steam pressure reaches at the predetermined pressure, the nonwoven fabric production apparatus starts to be driven. A time to a start of the drive can be shortened dramatically compared with a case without the steam outlet opening as in the conventional embodiment by new high temperature steam passing through the nozzle holder because the temperature of the nozzle holder can be raised quickly.

According to the present invention, as a shape of the tubular nozzle holder, specifically, a cylindrical nozzle holder and a rectangular nozzle holder can be presented. In particular, a cylindrical nozzle holder can be used preferably in terms of even flow of the pressurized steam and production. Moreover, at a time of real work, it is preferable to dispose a high mesh tubular filter inside a nozzle holder, that is, for example, in a case of a cylindrical nozzle holder, a cylindrical filter and in a case of a rectangular nozzle holder, a rectangular filter on a same axis, however, it is not always limited thereto.

According to the present invention, in a case a cylindrical nozzle holder is used as mentioned above, it is preferable to dispose a high mesh cylindrical filter inside the nozzle holder on the same axis. Here, the high mesh cylindrical filter denotes a filter having about a 1 to 50 μm diameter hole capable of eliminating fine foreign substances included at a time of introducing the steam. In this case, the steam introduced from the steam inlet opening provided on one end of the nozzle holder is introduced into the cylindrical filter so as to pass through the filter and reach at the nozzle hole formed in a nozzle plate, and then it is jetted from the nozzle hole to the outside. At this time, since a pressure distribution in the longitudinal direction at an inner wall surface of the nozzle holder is evened by the cylindrical filter and the fine foreign substances included at the time of introducing the steam can be eliminated from the steam by the cylindrical filter, the high-pressure steam can be jetted stably by an even jetting pressure from the nozzle holes without choking a plurality of the nozzle holes of the nozzle member formed along the nozzle holder longitudinal direction.

The nozzle holder has a drainage discharging opening in the lower part thereof. Furthermore, the nozzle holder is inclined by itself or together with the nozzle member. This is for facilitating discharge of the drainage pooled in the nozzle holder during the operation to the outside. Therefore, the drainage outlet opening is formed on a base end part on a lower side in a nozzle holder inclination direction so as to be opened or closed by for example an opening/closing valve, or the like so that the valve is opened in an arbitrary time zone for discharging the drainage pooled inside the nozzle holder to the outside. At this time, since the nozzle holder is disposed in an inclined form, an extra device for vacuuming, or the like is not needed. The nozzle holder may be inclined by itself or together with the nozzle member. Furthermore, in order to prevent choking of the nozzle holes, or the like by the drainage, it is also possible to provide a grade difference between a nozzle holder bottom surface and a nozzle member arrangement plane, or to form a drainage channel (groove) in the nozzle holder bottom surface, or furthermore, to provide a drainage channel partially communicating with the nozzle holder bottom surface independently of the nozzle holder. In a case the drainage channel is provided independently, the channel may be inclined by itself without inclining the nozzle holder as mentioned above. It is preferable that an inclination has a maximum gradient with respect to the horizontal line of 1/100. In a case the gradient is more than 1/100, since the drainage is pooled rapidly in the inclination base end part of the nozzle holder so that the drainage elimination should be carried out frequently, and furthermore, the steam pressure distribution in the nozzle holder can easily be uneven.

On the other hand, the opening formed in the nozzle holder lower surface may either be a slit like opening formed continuously in a nozzle holder length direction or a plurality of small holes formed zigzag in a nozzle holder longitudinal direction. The steam pressure reaching to the nozzle holes formed in the nozzle member via these openings is evened so that the steam can be jetted evenly in the nozzle longitudinal direction. The drainage channel is formed naturally at a portion off the opening of the nozzle holder.

The nozzle member may comprise a nozzle plate having a plurality of nozzle holes and a plate supporting member for supporting the nozzle plate. It is preferable that the nozzle holes have tubular holes. Although the tubular hole shape may be simply cylindrical, an inverse trapezoidal part may further be provided on the tubular hole upper end of the nozzle hole, or the nozzle hole may have a ring piece elongating from a lower end circumferential rim of the tubular hole into a hole opening coaxially, preferably concentrically. Furthermore, a continuous groove part having an inverse trapezoidal cross section continuously in the longitudinal direction of the nozzle plate, or an inverse truncated conical hole may be provided on the tubular hole upper end.

The nozzle hole formed in the nozzle plate may either be formed in a single row in the nozzle plate longitudinal direction, or for example in a plurality of rows in the nozzle plate width direction. In this case, if the nozzle holes in a plurality of rows are disposed zigzag, since the jetting water steam functions uniformly in the fiber web width direction, it is preferable.

A ratio value of the tubular hole, preferably a cylindrical hole height to an inner diameter is preferably 1 to 2. In a case the value is less than 1, the steam flow can hardly be a columnar flow. In a case it is more than 2, a highly sophisticated process is difficult due to a relationship between the minuteness of the nozzle hole diameter and the nozzle plate thickness. Moreover, according to a configuration of the nozzle hole having a ring piece elongating from the lower end circumferential rim of the cylindrical hole into the hole opening concentrically as mentioned above, the steam flow jetted from the nozzle hole can be converged at a certain point so that the jetting force with respect to for example the fiber web can be increased so as to easily pass through front and rear sides of the web. The converging point is determined according to the nozzle hole shape, the steam pressure, or the like.

It is preferable that the plate thickness of the nozzle plate is 0.5 to 1 mm, the steam jetting opening inner diameter of the nozzle hole is 0.05 to 1 mm, and a pitch between nozzles is 0.5 to 3 mm. In a case the plate thickness of the nozzle plate is less than 0.5 mm, strength capable of sufficiently enduring the steam pressure can hardly be obtained. In a case it is more than 1 mm, the nozzle hole can hardly be processed sophisticatedly. For the nozzle hole forming process, an electric discharge process or a laser process can be adopted. Moreover, in a case the steam jetting opening inner diameter of the nozzle hole is less than 0.05 mm, not only the process thereof is difficult but also choking can easily be generated. In a case it is more than 1 mm, a predetermined jetting force can hardly be obtained at a time of jetting the steam. As long as an inter-nozzle pitch is 0.5 to 3 mm, the fiber web constituent fibers can be entangled sufficiently at a same time. The inter-nozzle pitch denotes a distance between the central points of the nozzle holes.

Furthermore, according to the present invention, the nozzle holder may comprise a single member having a ship like recessed groove part communicating with a lower end opening of the nozzle holder, a rectangular cross-section groove part formed along a ship bottom part of the recessed groove part, a plurality of inverse truncated conical holes formed by a predetermined pitch along the longitudinal direction of the rectangular cross section groove part, and a cylindrical hole formed continuously on lower end of the inverse truncated conical hole. By providing the nozzle member as a single member accordingly, not only a number of parts can be cut back drastically but also a jetting opening end of the nozzle hole can be approached directly to a jetted surface of the fiber web so that the pressure decline by an adiabatic expansion of the pressurized steam can be alleviated and a through force in the web can be obtained more.

Furthermore, by providing a lower end face shape in the width direction of the nozzle member as a curved surface shape projecting downward, introduction of the fiber web can be facilitated. Also according to the present invention, the value of the ratio of the tubular hole height to the inner diameter is preferably 1 to 2. Moreover, it is preferable that the steam jetting opening inner diameter of the nozzle hole is 0.05 to 1 mm, and the pitch between the nozzles is 0.5 to 3 mm. The inter-nozzle pitch in this case denotes also the distance between the central points of the nozzle holes as mentioned above. Also in this case, it is preferable that the nozzle holes are formed in a plurality of rows in the longitudinal direction of the nozzle member.

The pressurized steam jetting nozzle of the present invention having the above-mentioned configurations can be adopted preferably for example for a production method for a nonwoven fabric of the present invention as follows.

That is, a basic configuration of the invention according to a production method for a nonwoven fabric is a production method for a nonwoven fabric of entangling the constituent fibers by continuously jetting the pressurized steam in a width direction of a running fiber web from the plurality of the nozzle holes, using the pressurized steam jetting nozzle comprising the tubular nozzle holder having on one end the steam inlet opening to be connected with the pressurized steam supply tube, on another end the steam outlet opening to be connected with the steam discharge tube of the outside, and the opening elongating along the longitudinal direction of the lower surface, and a nozzle member disposed detachably on the lower surface of the nozzle holder, having a plurality of nozzle holes formed facing the opening, characterized by comprising steps of initially introducing the pressurized steam from the steam inlet opening, discharging the pressurized steam from the steam outlet opening to the outside, measuring the temperature inside the pressurized steam jetting nozzle, stopping the discharge of the steam by switching the steam outlet path to a drainage eliminating path via a trap at the time the temperature inside the nozzle reaches at a predetermined temperature, running the fiber web continuously in a state facing the jetting nozzle holes of the nozzle after a stoppage of discharge of the steam so as to entangle the fiber web constituent fibers by the pressurized steam jetted from the jetting nozzle holes, and vacuuming the steam passing through the fiber web so as to discharge the same to the outside.

According to such a production method, efficient production can be enabled by a production apparatus for a nonwoven fabric of the present invention comprising a following basic configuration.

That is, the basic configuration of the production apparatus relates to the apparatus for producing a nonwoven fabric by entangling the constituent fibers by jetting pressurized steam to a running fiber web from a plurality of nozzle holes formed in the longitudinal direction of a pressurized steam jetting nozzle facing the fiber web, characterized by comprising a pressurized steam supply source connected with one end of the pressurized steam jetting nozzle via a pressurized steam supply tube, a steam discharge tube connected with another end of the pressurized steam jetting nozzle via an opening/closing valve, fiber web supporting and transporting means facing the plurality of the pressurized steam jetting nozzle holes formed in the pressurized steam jetting nozzle by a predetermined interval, having a large number of holes, to be moved in one direction across the pressurized steam jetting nozzle, and vacuuming means disposed on an opposite side of the pressurized steam jetting nozzle interposing the transporting means. As the pressurized steam jetting nozzle, it is preferable to adopt the pressurized steam jetting nozzle according to the present invention as mentioned above.

The nozzle holder of the pressurized steam jetting nozzle is, in general, wrapped by an insulating material, or the like so as to prevent the temperature drop of the pressurized steam passing through the inside thereof. Furthermore, an entirety of the pressurized steam jetting nozzle may be heated actively. As a specific method therefor, heating by a heat medium such as a silicone based oil, a heating method by an electric heater such as induction heating, or the like can be presented. In addition thereto, for example, with the entirety of the pressurized steam jetting nozzle stored in a box whose pressurized steam jetting side is opened, hot air heated to a high temperature is introduced into the box. By heating the entirety of the pressurized steam jetting nozzle accordingly by hot air to for example a temperature of a saturation steam temperature of the steam to be used or more, the temperature drop of the pressurized steam in the inside can effectively be prevented so that not only the necessary steam amount to be applied to the nonwoven fabric can effectively be obtained but also a high quality nonwoven fabric entangled and thermally fused deeply can easily be obtained.

In contrast, in general the pressurized steam jetting nozzle is disposed above the running fiber web so as to apply the pressurized steam jetting flow toward an upper surface of the fiber web. However, it is also possible to dispose the pressurized steam jetting nozzle below the running fiber web so as to apply the pressurized steam jetting flow upward from a lower surface of the fiber web. In a case the pressurized steam jetting flow is jetted upward from below the fiber web, condensed liquid of the steam can hardly be pooled in the nozzle hole disposed on an upper surface side of the nozzle holder so as to enable stable steam jetting, and thus it is preferable.

Although a desired object of the present invention can be achieved also by applying the pressurized steam from one surface of the fiber web by a pair of the pressurized steam jetting nozzle and the vacuuming means of the steam disposed facing the nozzle, it is also possible to prepare two or more pairs of the pressurized steam jetting nozzle and the steam vacuuming means and dispose the same alternately for jetting the pressurized steam to the fiber web from the front and rear surfaces.

In this case, since the entangling function by the pressurized steam can be applied not only from one side of the fiber web constituent fibers but also from front and rear sides independently, the fiber web constituent fibers can be entangled and thermally fused evenly on the front and rear surfaces so that not only a shape stability as the nonwoven fabric, but also a high quality nonwoven fabric with a neat external appearance on the front and rear sides can be obtained.

Moreover, a steam reflecting plate can be disposed between the fiber web running in one direction and the vacuuming means. The steam reflecting plate preferably has a large number of holes with a 1 to 10 mm diameter, with a 10 to 50% aperture ratio. In a case these values are smaller than them, the steam vacuuming force by the vacuuming means at a time of passing the fiber web cannot work effectively. Moreover, in a case the values are larger than them, the steam amount to be reflected becomes too small. While the pressurized steam jetted from the pressurized steam jetting nozzle passes through the fiber web, the constituent fibers are entangled. However, according to a comparison of the fiber entangling state on a pressurized steam jetting side and a passing through side of the fiber web, the entanglement of the constituent fiber on the steam jetting side is more promoted than the entanglement of the constituent fibers on the passing through side. Then, by disposing the steam reflecting plate as mentioned above, the steam passed through the fiber web can be reflected to a passing through side surface of the fiber web by the steam reflecting plate so as to promote the entanglement among the constituent fibers on a steam reflecting plate side. For example, also in a case the pressurized steam is jetted from one direction to the fiber web, not only the fiber entanglement on the opposite side surface is promoted but also the constituent fibers projected to the fiber web passing through side can be pushed to the jetting side so as to be entangled, and thus a nonwoven fabric whose front and rear surfaces are even and stable can easily be obtained.

Furthermore, if the fiber web transporting means comprises a porous fiber web supporting and transporting means disposed between the nozzle hole of the pressurized steam jetting nozzle and the fiber web, and a porous fiber web pressing and transporting means for clamping the fiber web with respect to the fiber web supporting and transporting means for transporting the fiber web in cooperation with the fiber web supporting and transporting means for transporting the fiber web clamped between the fiber web supporting and transporting means and the fiber web pressing and transporting means, the web surface fibers cannot be disturbed even if the high temperature and high pressure steam is jetted to the fiber web being transported, and thus it is preferable. At this time, both the fiber web supporting and transporting means and the pressing and transporting means may comprise porous endless belts to be driven and rotated synchronously with each other by a driving source, or either one of the fiber web pressing and transporting means and the fiber web supporting and transporting means may be an endless belt to be driven and rotated, and the other one is a porous rotary drum to be driven and rotated synchronously with the endless belt.

It is preferable that a vacuuming means having a slit like vacuuming opening is provided at a portion inside either of the endless belts and facing the nozzle hole of the pressurized steam jetting nozzle in the former case, and that a vacuuming means having a slit like vacuuming opening is provided inside the endless belt or the rotary drum at a portion where the endless belt and the rotary drum are most proximate. These vacuuming means are installed in a fixed state such that the endless belt or the rotary drum is rotated adjacently to a slit like vacuuming opening surface.

In a case a porous rotary drum is adopted for either one of the fiber web pressing and transporting means and the fiber web supporting and transporting means, miniaturization of the entire apparatus can be achieved. For a structure and an arrangement of the rotary drum and the vacuuming means, the substantially same structure and arrangement of the rotary drum and the vacuuming means adopted for a cylinder paper machine can be adopted. Moreover, as the porous endless belt and the rotary drum, for example, a metal mesh and a punching metal can be used. At this time, it is preferable that a mesh degree of the fiber web pressing and transporting means does not exceed that of the fiber web supporting and transporting means. In general, it is preferable to provide a 20 to 40 (pieces/2.54 cm) mesh degree of the transporting means. Especially in a case the mesh degree of the fiber web pressing and transporting means is less than 20 (pieces/2.54 cm), the constituent fibers on the surface side to be pressed by the pressing and transporting means pass through the mesh so as to project to the surface and expand in a lateral direction. Moreover, especially in a case the mesh degree of the fiber web pressing and transporting means is more than 40 (pieces/2.54 cm), choking can easily be generated so that the jetted steam expands along the surface of the fiber web pressing and transporting means so as to prevent penetration of the jetted steam with respect to the fiber web. Also as to the mesh degree of the fiber web supporting and transporting means, if it is outside the above-mentioned range, a high quality nonwoven fabric can hardly be produced.

In general, the pressurized steam jetting nozzle is fixed at a predetermined position in an unmovable state, and the fiber web pressing and transporting means and the fiber web supporting and transporting means are merely moved in one direction for transporting the fiber web in one direction. According to the present invention, it is preferable that the pressurized steam jetting nozzle is moved reciprocally by a short stroke in a traverse direction of a transporting path for the fiber web, or the fiber web pressing and transporting means and fiber web supporting and transporting means are moved reciprocally also by a short stroke in the traverse direction of the fiber web transporting path with the pressurized steam jetting nozzle fixed. In a case either the pressurized steam jetting nozzle or the fiber web pressing and transporting means and the fiber web supporting and transporting means is moved reciprocally, the pressurized steam is jetted and applied evenly in a fiber web width direction so that a moiré like pattern by the steam jetted from the nozzle hole does not remain on the surface of the nonwoven fabric to be produced so that a nonwoven fabric having a homogeneous surface state can be obtained. A stroke width of the reciprocal movement should be longer than an inter-nozzle pitch slightly. Specifically, it is about ±5 mm, and the reciprocal movement speed is 30 to 300 times/minute.

It is preferable that a gap between the nozzle hole of the pressurized steam jetting nozzle and the fiber web pressing and transporting means is as small as possible, and if possible, it is most preferable that they slide with each other directly. However, if the nozzle hole of the pressurized steam jetting nozzle and the fiber web pressing and transporting means slide with each other, they are damaged drastically by wear so that a desired endurance cannot be obtained. Therefore, it is preferable that means for adjusting the gap is provided between the nozzle hole of the pressurized steam jetting nozzle and the fiber web pressing and transporting means. By the gap adjusting means, the gap between the nozzle hole of the pressurized steam jetting nozzle and the fiber web pressing and transporting means can be adjusted optimally and at a same time an endurance of the apparatus can be ensured. Moreover, a second gap adjusting means can be provided for adjusting a gap between the fiber web pressing and transporting means and the fiber web supporting and transporting means. This is preferable for adjusting a clamping force, corresponding to a constituent fiber material of the fiber web and the web thickness.

Moreover, according to the production apparatus for a nonwoven fabric of the present invention, it is preferable that a steam storage part is disposed in a conduit of the pressurized steam supply tube for temporarily storing the steam in the steam storage part so as to discharge dusts, or the like in the steam stored therein together with condensed liquid via for example a trap. Furthermore, by disposing heating means in the conduit of the pressurized steam supply tube between the steam storage part and one end of the pressurized steam jetting nozzle for heating the steam passing through a heated steam supply tube of the pressurized steam between the steam storage part and the steam jetting nozzle so as to produce the superheated steam, the high temperature steam can be jetted to the fiber web under a desired high pressure, and thus it is preferable. At this time, by having the steam pressure introduced into the steam jetting nozzle of 0.1 to 2 MPa, the steam can certainly pass through the front and the rear sides of the fiber web, and thus it is preferable.

The pressurized steam jetted from the steam jetting nozzle has a drastic temperature drop by the adiabatic expansion simultaneously when it is jetted from the nozzle hole to the outside. According to the temperature drop, the steam is condensed so as to easily become a fog like liquid and it blows up in a periphery so as not to be any longer a high pressure fluid, and thus it can hardly reach to the inside of the fiber web. The superheated steam is steam having a high temperature to the saturation temperature or higher than that under the saturated steam pressure so that it can hardly become a condensed liquid between the saturation temperature and a superheating temperature. Therefore, the superheated steam jetted form the steam jetting nozzle cannot be condensed even at a time of contacting with the fiber web so as to penetrate to the inside and pass it through for entangling peripheral fibers while heating. Therefore, according to a passage of the superheated steam, entanglement and a thermal fusion of the fibers can be executed at a same time.

Also according to the production apparatus for a nonwoven fabric of the present invention, it is preferable that pre-process means is disposed on an upstream side from the pressurized steam jetting nozzle in a fiber web transporting direction for facilitating the entanglement of the fibers with each other in the web by the steam jetting nozzle.

By executing the pre-process for shortening a distance among the fibers comprising the fiber web at a stage before entangling the fibers by jetting the steam as mentioned above, entanglement of the fibers with each other in the fiber web can be executed effectively by jetting the high pressure steam without difficulty.

According to the present invention, as a entanglement facilitating means, although merely spraying a liquid to the surface of the fiber web is sufficient, for example, the fiber entanglement by the conventional liquid flow or needle punch can also be adopted. For example, if it is wetted by water, the web is thinned in appearance so that a distance between the fibers is shortened so as to facilitate the entanglement. The pre-process is effective also for preventing fuzzing or scattering of the fiber from the web surface by the jetted steam. Furthermore, as the above-mentioned pre-process, it is also possible to mix a low melting point fiber at least partially in the fiber web constituent fibers and dispose a heating device for further promoting the thermal fusion thereof.

Moreover, according to the production apparatus for a nonwoven fabric of the present invention, it is also possible to dispose a trap conduit branched from a conduit of the steam discharge tube between the opening/closing valve and another of the pressurized steam jetting nozzle. Prior to the start of the drive of the apparatus, the opening/closing valve provided in the steam discharging tube connected with the steam outlet opening of the pressurized steam jetting nozzle is opened for introducing the pressurized steam from one end of the pressurized steam jetting nozzle and discharging the steam from the steam outlet opening of the other end, and at a time an internal temperature of the pressurized steam jetting nozzle is raised to a predetermined temperature, the opening/closing valve is closed.

If the trap conduit branched from the conduit of the steam discharging tube is provided as mentioned above, even after closing the opening/closing valve, the condensed liquid generated in the pressurized steam jetting nozzle, the minute foreign substances contained in the steam, or the like flows to the trap conduit via the steam discharging tube together with the condensed liquid so as to be discharged to the outside timely so that the steam can be jetted stably from the all nozzle holes without choking the nozzle holes by the condensed liquid or the minute foreign substances at a time of the drive of the apparatus. As the pressurized steam jetting nozzle to be adopted in the production method and the production apparatus of the present invention, the pressurized steam jetting nozzle of the present invention comprising the configurations already mentioned can be adopted. Moreover, although an example provided with one stage of the pressurized steam jetting nozzle has been described in the explanation, the steam jetting nozzle may be disposed in a multiple stages in a fiber web running direction. In this case, as it has already been described, by disposing the pressurized steam jetting nozzle and the vacuuming means thereof alternately on the front and rear sides with respect to the fiber web, a high quality nonwoven fabric with the stable surface state can be obtained.

Furthermore, it is preferable to displace a nozzle hole arrangement of the pressurized steam jetting nozzle in each stage in the fiber web width direction.

BEST MODE OF CARRYING OUT THE INVENTION

Figure 1:
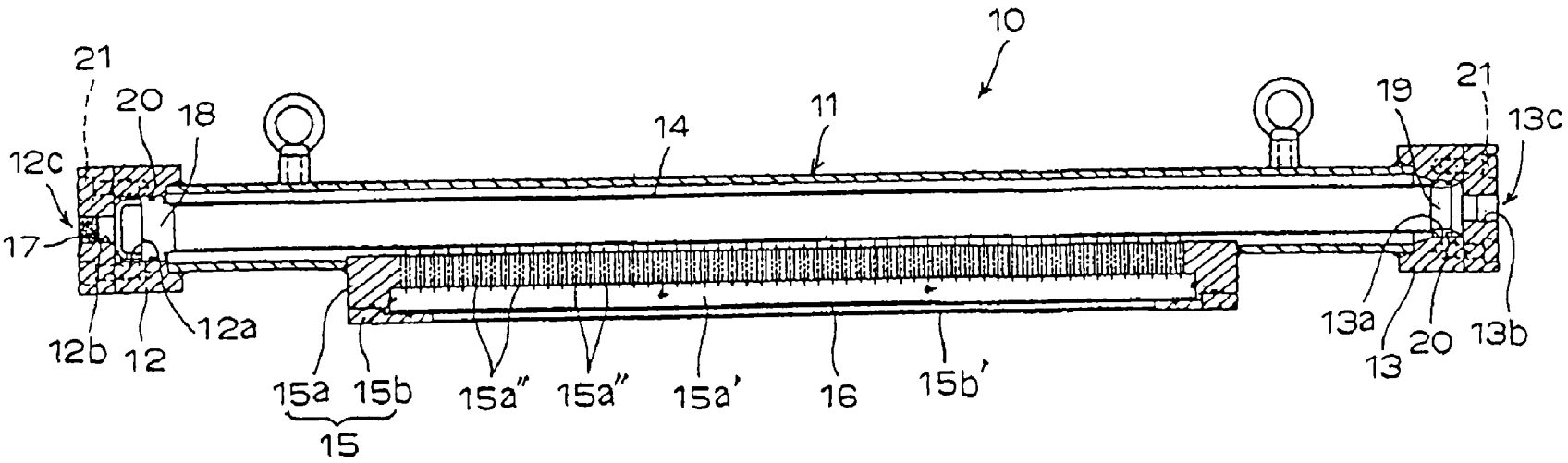
FIG. 1 is a vertical cross sectional view showing a first structure embodiment of a pressurized steam jetting nozzle according to the present invention.

Hereinafter, representative embodiments of the present invention will be explained specifically with reference to the drawings.

FIGS. 1 to 4 show a representative first structure embodiment of a pressurized steam jetting nozzle according to the present invention. The pressurized steam jetting nozzle 10 according to the first structure embodiment comprises a nozzle holder 11, first and second flanges 12, 13 fixed by welding on both end parts of the nozzle holder 11, a cylindrical high mesh filter 14 inserted through an inside of the nozzle holder 11 with both end parts supported by the first and second flanges 12, 13, and a nozzle member 15 having a plurality of nozzle holes fixed by welting or a bolt, or the like along a lower surface of the nozzle holder 11. The nozzle member 15 of the embodiment shown in the figures comprises first and second nozzle plate supporting members 15*a*,

15*b*, and a nozzle plate 16 to be fastened by a fixing bolt between the first and second nozzle plate supporting members 15*a*, 15*b*.

The first flange 12 fixed on a steam inlet side end part of the nozzle holder 11 having a through hole 12*c* with a large diameter part 12*a* and a small diameter part 12*b* along a central line is connected with an unshown pressurized steam supply tube via a plug 17 connected to an unshown pressurized steam supply source. The second flange 13 fixed on a steam outlet side end part of the nozzle holder 11 having a through hole 13*c* with a large diameter part 13*a* and a small diameter part 13*b* along a central line is connected with an unshown steam outlet tube. On the both end parts of the high mesh filter 14 are provided ring like fixing members 18, 19 to be fixed airtightly on the large diameter parts 12*a*, 13*a* of the first and second flanges 12, 13.

Figure 2:
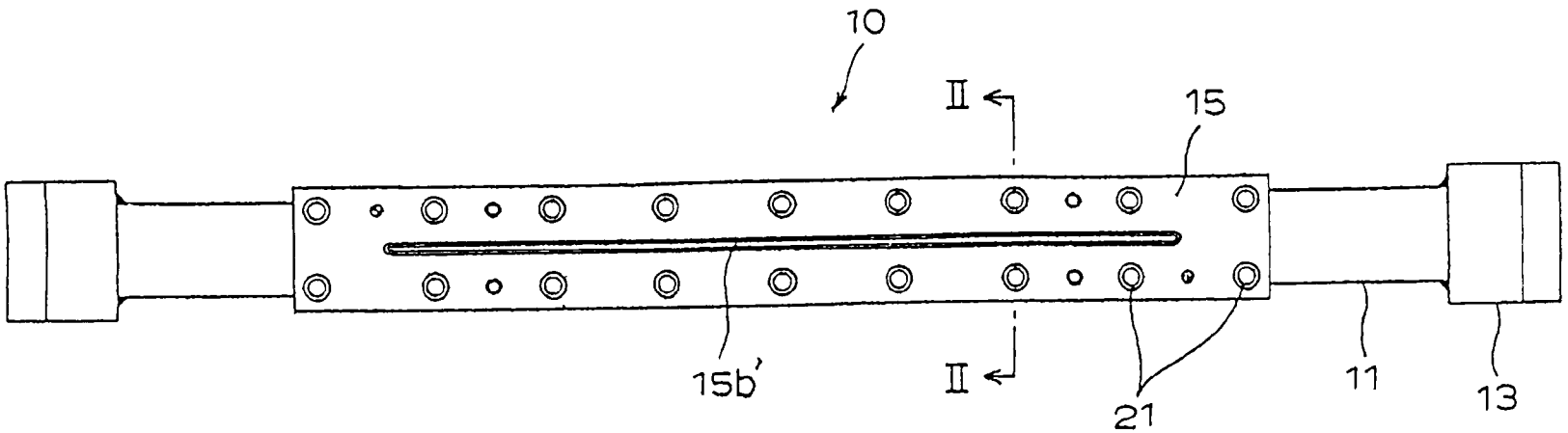
FIG. 2 is a rear view of the nozzle.

An eliminated surface 11*a* eliminated planarly up to an internal space with both end parts remained is formed on a lower surface part of the nozzle holder 11. As a result, a slit like opening 11*b* elongating in a longitudinal direction is formed in a lower surface center of the nozzle holder 11. As shown in FIGS. 1 and 2, the nozzle member 15 comprises a prism columnar first nozzle plate supporting member 15*a* and a plate like second nozzle plate supporting member 15*b* having a same length and width as those of the first nozzle plate supporting member 15*a*. In a lower surface central part of the first nozzle plate supporting member 15*a*, a recessed part 15*a*' elongating in the longitudinal direction is formed excluding the both end parts in the longitudinal direction. Moreover, in an upper surface central part thereof, a plurality of through holes 15*a*" communicating with the recessed part 15*a*' are formed zigzag in the longitudinal direction as shown and enlarged in FIG. 4.

Figure 4:
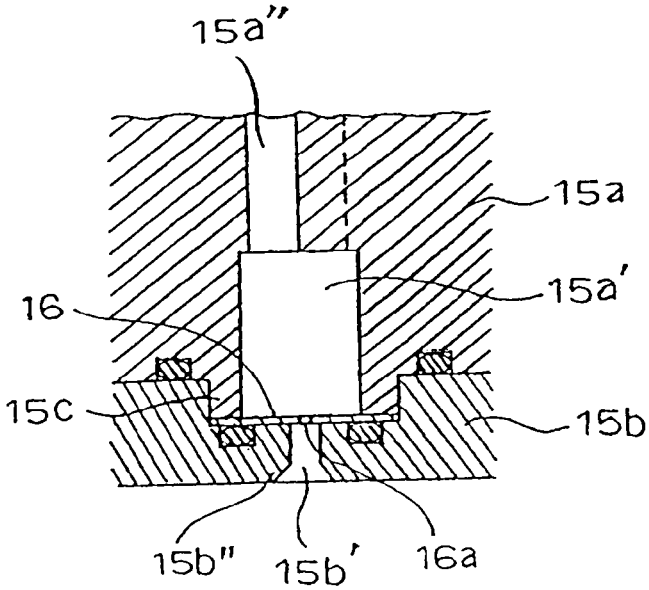
FIG. 4 is an enlarged view of an A part shown by an arrow in FIG. 3.

On the other hand, in the second nozzle plate supporting member 15*b*, as shown and enlarged in FIG. 4, a slit like opening 15*b*' elongating in the longitudinal direction is formed at a portion corresponding to the recessed part 15*a*'. Across section of the slit like opening 15*b*' is a vertical rectangular cross section on a side facing the recessed part 15*a*' and a trapezoidal cross section expanded continuously downward on a lower end thereof. Moreover, a portion of the second nozzle plate supporting member 15*b* with the slit like opening 15*b*' formed is formed as a thin part 15*b*" than another parts by a predetermined width, and a lower surface of the first nozzle plate supporting member 15*a* facing the thin part 15*b*" has a projecting part 15*c* to be fitted to the thin part 15*b*".

Figure 3:
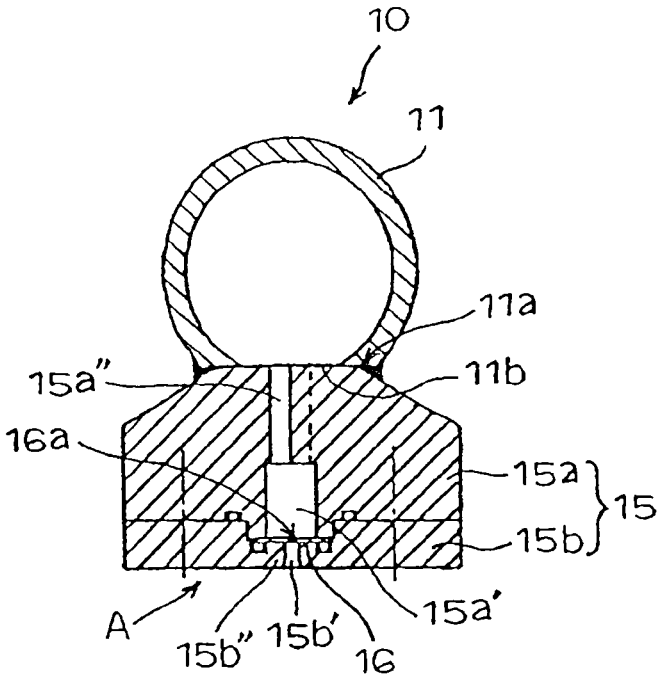
FIG. 3 is a cross-sectional view viewed in an arrow direction taken along a line II-II in FIG. 2.

The nozzle plate 16 comprising a narrow thin plate piece having a size and a shape to be fitted to the thin part 15*b*" has a plurality of nozzle holes 16*a* formed in a row or a plurality of rows in a longitudinal direction by a predetermined pitch in a center in a width direction thereof. As shown in FIGS. 1 and 3, the first nozzle plate supporting member 15*a* is fixed integrally by welding in a state with an upper surface of the first nozzle plate supporting member 15*a* contacted closely with the eliminated surface 11*a* of the nozzle holder 11. The nozzle plate 16 is supported firmly by airtightly fixing the first nozzle plate supporting member 15*a* and the second nozzle plate supporting member 15*b* by a bolt 21 via an O ring 20 in a state clamped between contacted surfaces of the projecting part 15*c* of the first nozzle plate supporting member 15*a* and the thin part 15*b*" of the second nozzle plate supporting member 15*b*. Therefore, since the nozzle plate 16 can be detached easily by removing the bolt 21, it can be washed or replaced easily.

Figure 5:
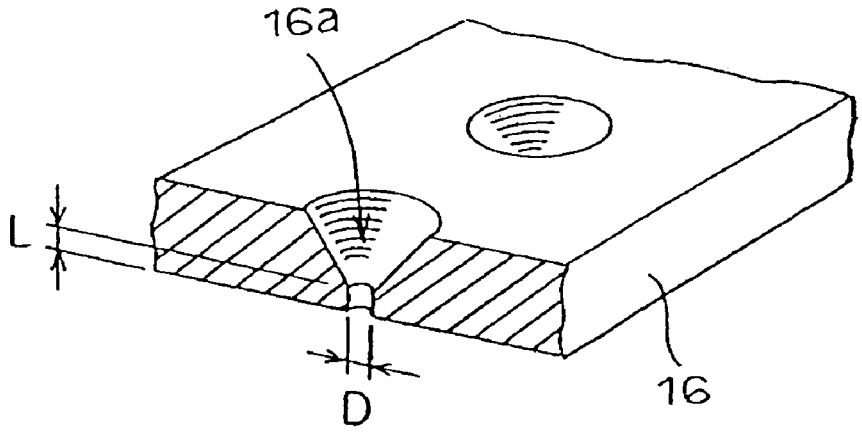
FIG. 5 is a cross sectional view showing a modified embodiment of a nozzle hole shape of the pressurized steam jetting nozzle.
Figure 6:
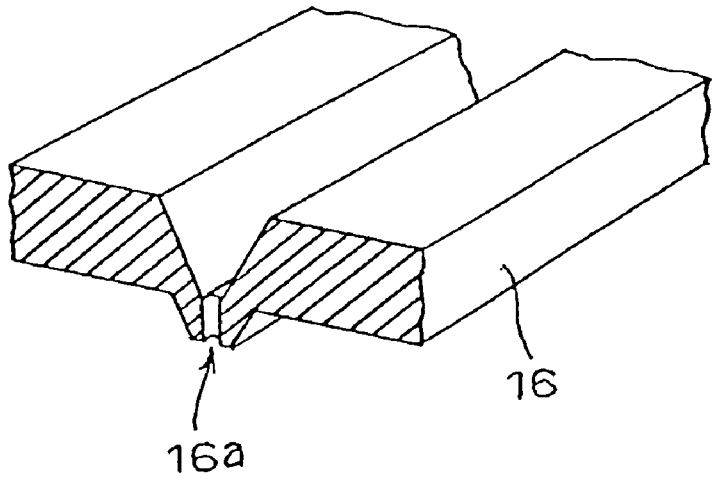
FIG. 6 is also a partial perspective view showing another modified embodiment of a nozzle hole shape of the pressurized steam jetting nozzle.
Figure 7:
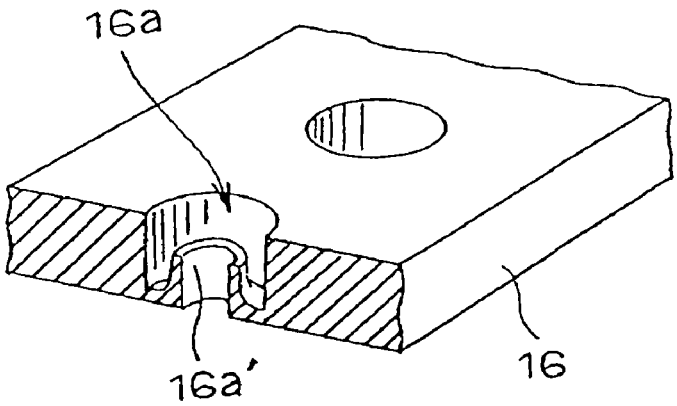
FIG. 7 is a cross sectional view showing still another modified embodiment of a nozzle hole shape of the pressurized steam jetting nozzle.

The nozzle hole 16*a* may have not only a simple cylindrical shape but shapes as shown in FIGS. 5 to 7. As to the shape of the nozzle hole 16*a* shown in FIG. 5, it has an upper part having an inverse truncated conical shape and a lower part provided continuously to the inverse trapezoidal conical shape formed in a cylindrical shape. At a time this hole shape is adopted, as shown in the figure, with a premise that a height of the cylindrical shape is L and an aperture of the cylindrical shape is D, it is preferable that a value of L/D is 1 to 2 in terms of both ensuring a preferable converging property of the jetting flow and enabling a highly sophisticated hole process.

FIG. 6 shows a shape having a groove with an inverse trapezoidal cross section formed in the an surface of the nozzle plate 16 and a plurality of cylindrical holes formed by a predetermined pitch in a longitudinal direction in a bottom surface thereof, and furthermore, both right and left end faces along the cylindrical hole rows cut off. At this time, if a top end ridgeline part of a projecting cylindrical holes are formed in an arc like surface, surface fibers of a fiber web cannot be disturbed even in a case the fiber web is contacted with or approached to the nozzle holes 16*a* at a time of jetting the steam. As to the shape of the nozzle holes 16*a* shown in FIG. 7, a ring piece 16*a*' elongating concentrically to an inner side is formed from a lower end circumferential rim of the cylindrical holes. By adopting this hole shape, the high pressure steam jetted from the nozzle holes 16*a* provides a converging flow.

According to the pressurized steam jetting nozzle 10 having these configurations, as it will be described later, in a case of, for example, jetting a high temperature high pressure steam from the pressurized steam jetting nozzle 10, the steam is introduced from one end of the pipe like nozzle holder 11 at a time of starting a drive and discharged from another end. Since fresh high temperature high pressure steam can pass through the inside of the nozzle holder 11 without any obstacle, temperature of the nozzle holder 11 which is low at first can be raised to a predetermined temperature in a short time. In a case of providing only the steam inlet opening to the nozzle holder as in a conventional embodiment, even in a case the fresh high temperature high pressure steam is introduced to the nozzle holder, since the steam fills the inside of the holder without passing through the inside of the nozzle holder, the steam can easily be condensed so that the temperature rise of the nozzle holder requires a long time.

It is preferable that a plate thickness of the nozzle plate 16 is 0.5 to 1 mm. In a case it is smaller than 0.5 mm, a strength capable of sufficiently enduring the steam pressure can hardly be obtained. In a case it is more than 1 mm, a minute nozzle hole 16*a* can hardly be processed sophisticatedly. For a nozzle hole 16*a* forming process, an electric discharge process or a laser process can be adopted. Moreover, in a case a steam jetting opening inner diameter of the nozzle hole 16*a* is less than 0.05 mm, not only the process thereof is difficult but also choking can easily be generated. In a case it is more than 1 mm, a predetermined jetting force can hardly be obtained at a time of jetting the steam. As long as the inter-nozzle pitch is 0.5 to 3 mm, the fiber web constituent fibers can be entangled sufficiently.

Figure 8:
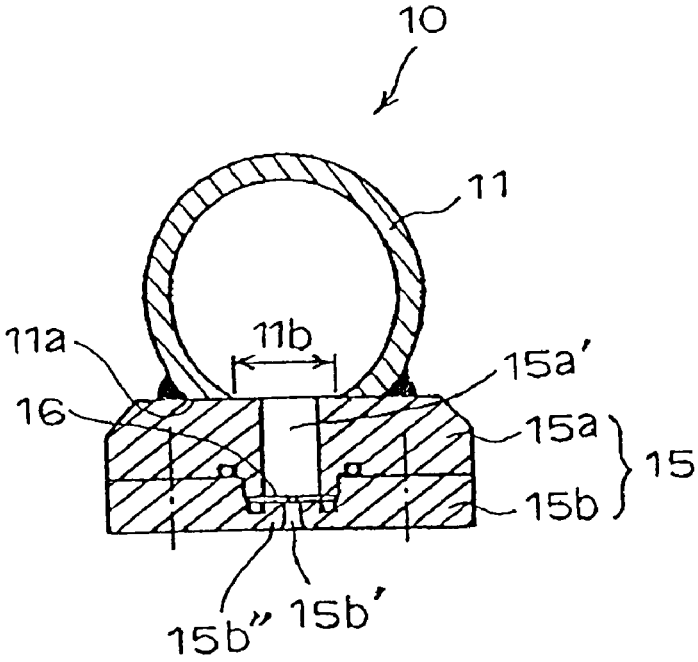
FIG. 8 is a cross sectional view showing a second structure embodiment of a pressurized steam jetting nozzle according to the present invention, corresponding to FIG. 3.

FIG. 8 shows a second structure embodiment of the pressurized steam jetting nozzle 10 according to the present invention. The second structure embodiment differs from the first structure embodiment in a structure of the first nozzle plate supporting member 15*a* fixed by welting to the eliminated surface 11*a* of the nozzle holder 11. According to the second structure embodiment, the through holes 15*a*" arranged zigzag from the first nozzle plate supporting member 15*a* are excluded, and the recessed part 15*a*' communicates directly with the slit like opening 11*b* formed in the eliminated surface 11*a* of the nozzle holder 11. This is because, according to the high temperature high pressure steam with a steam pressure in the nozzle holder 11 being in a stable state, pressure distribution is barely fluctuated in the longitudinal direction thereof and the steam flow is disturbed oppositely due to the presence of the through holes 15*a*". Moreover, since a plurality of the through holes 15*a*" are excluded from the first nozzle plate supporting member 15*a*, the structure is simplified and the process thereof can be facilitated as well.

Figure 9:
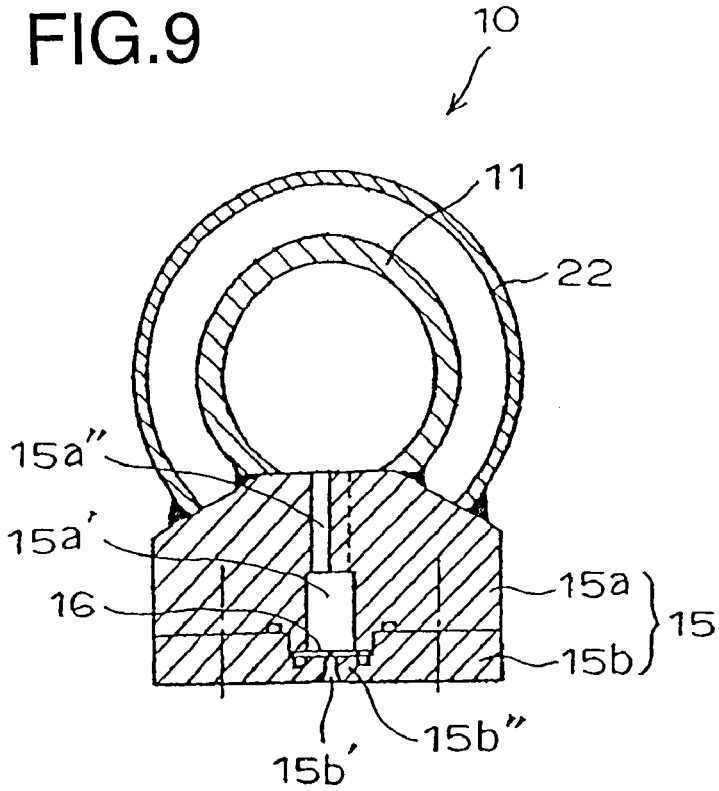
FIG. 9 is a cross sectional view showing a third structure embodiment of a pressurized steam jetting nozzle according to the present invention, corresponding to FIG. 3.

FIG. 9 shows a third structure embodiment of the pressurized steam jetting nozzle 10 according to the present invention. The third structure embodiment and the first structure embodiment differ in that a circumference of the nozzle holder 11 is wrapped by a cylindrical jacket 22 with a lower surface opened and an opening end part is fixed to the first nozzle plate supporting member 15*a* by welding. By supplying a heating medium such as the steam and a heat medium to an inside of the cylindrical jacket 22 for heating, generation of a partial condensation of the steam inside the nozzle holder 11 by a cooling function by an external atmosphere can be prevented. It is also effective to heat by an electrothermal heater, or the like instead of the cylindrical jacket 22.

Figure 10:
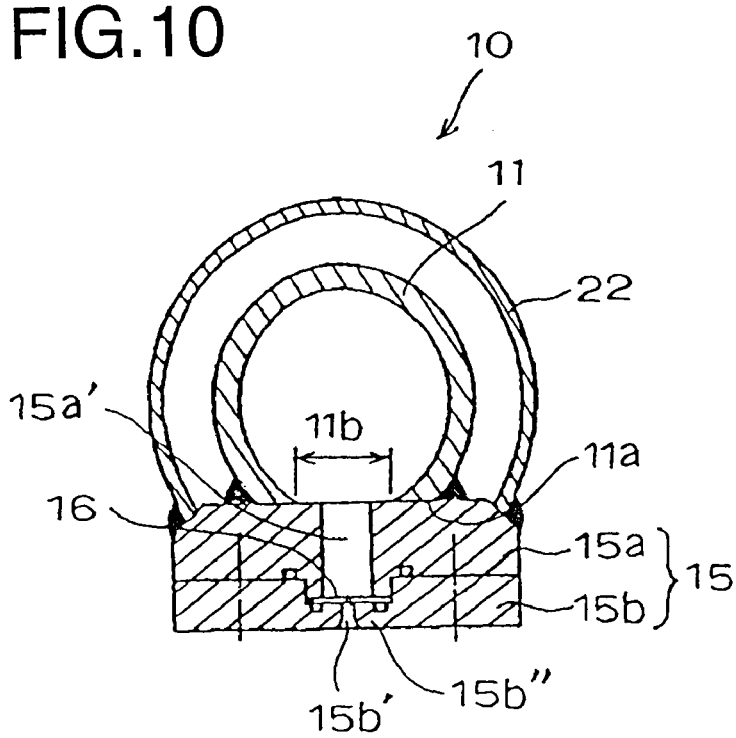
FIG. 10 is across sectional view showing a fourth structure embodiment of a pressurized steam jetting nozzle according to the present invention, corresponding to FIG. 3.

FIG. 10 shows a fourth structure embodiment of the pressurized steam jetting nozzle 10 according to the present invention. The fourth structure embodiment differs from the third structure embodiment in the structure of the first nozzle plate supporting member 15*a* fixed by welting to the eliminated surface 11*a* of the nozzle holder 11 as in a case of the difference between the first structure embodiment and second structure embodiment. According to the fourth structure embodiment, the through holes 15*a*" arranged zigzag from the first nozzle plate supporting member 15*a* in the third structure embodiment are excluded, and the recessed part 15*a*' communicates directly with the slit like opening 11*b* formed in the eliminated surface 11*a* of the nozzle holder 11. As to a function thereof, in addition to the function in the second structure embodiment, furthermore, the function of the third structure embodiment is provided.

Figure 11A:
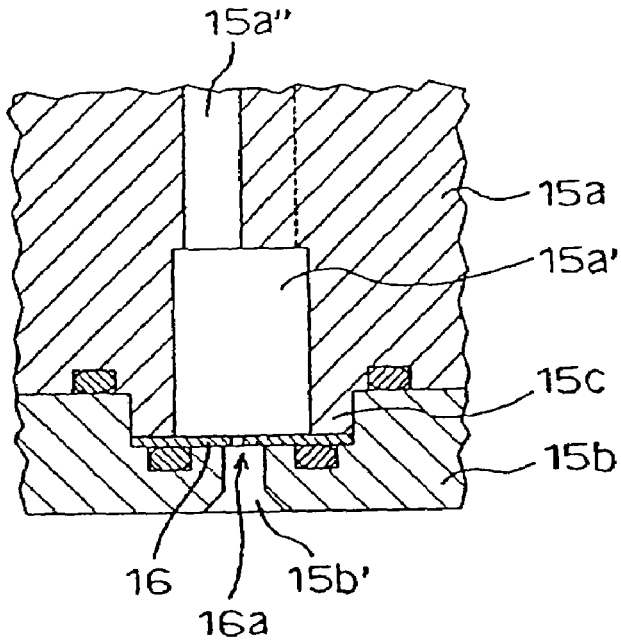
FIG. 11 is an explanatory diagram of the nozzle of another arrangement embodiment of the nozzle hole of the pressurized steam jetting nozzle according to the present invention.
Figure 11B:
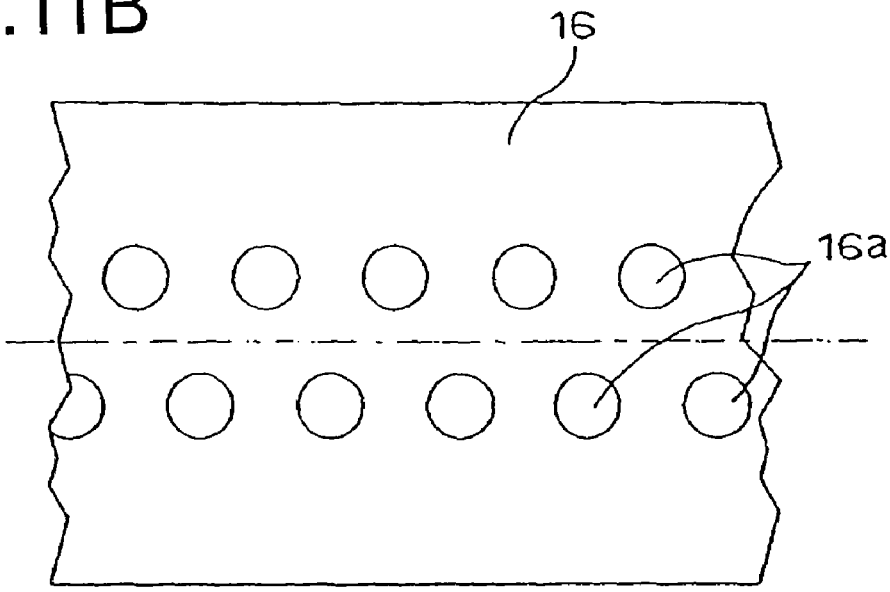
Figure 12:
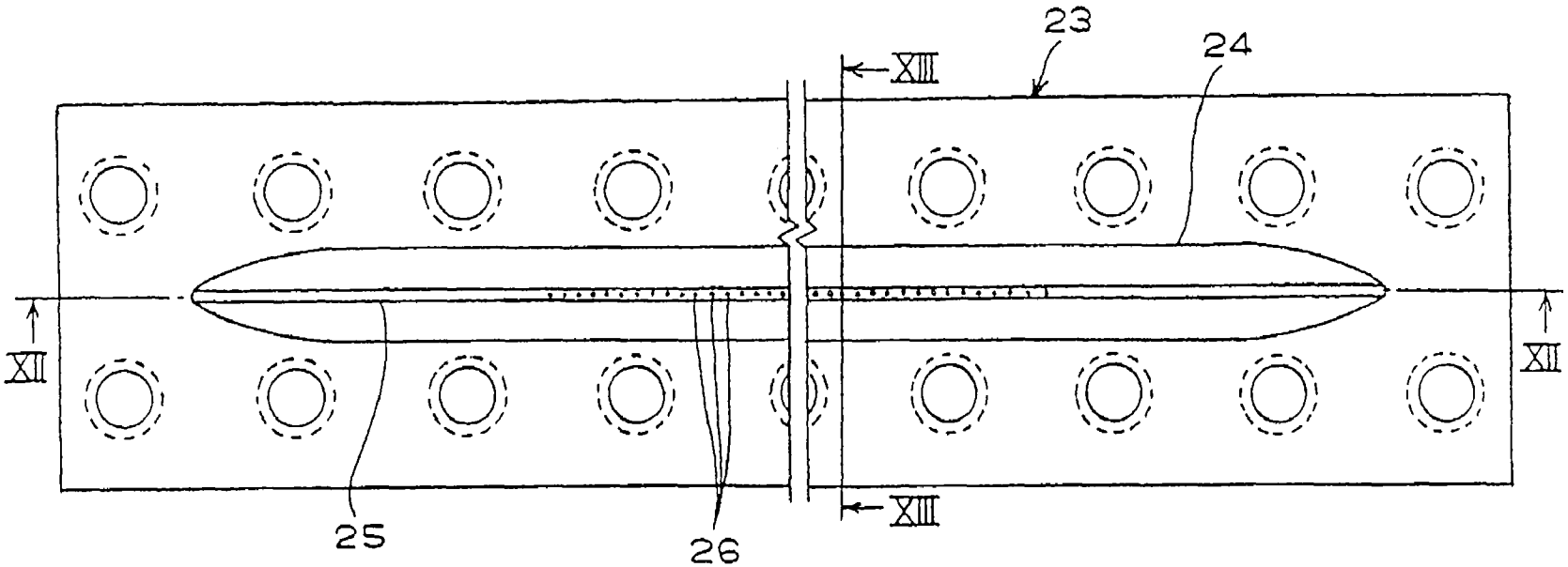
FIG. 12 is a top view showing an embodiment of the nozzle member of the pressurized steam jetting nozzle according to a second embodiment of the present invention.
Figure 13:
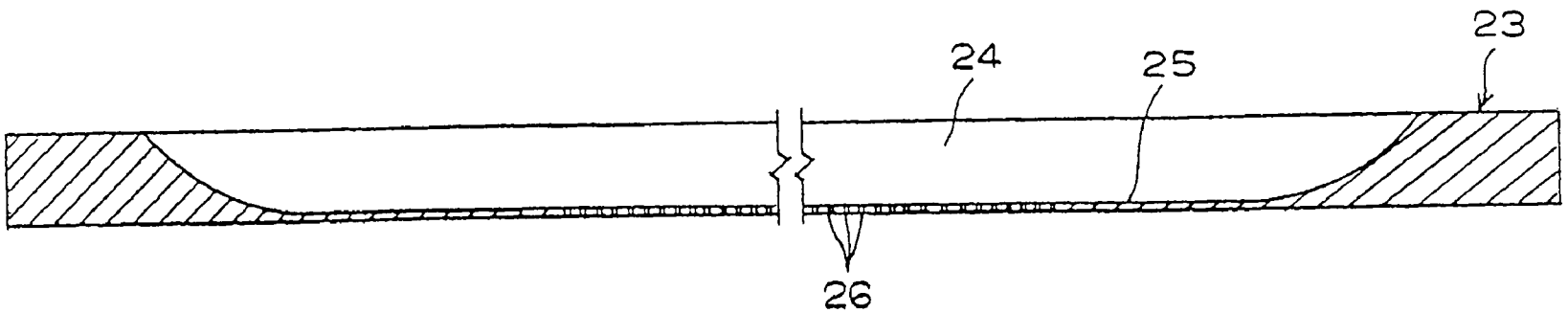
FIG. 13 is a cross sectional view viewed in an arrow direction taken along a line XII-XII of FIG. 12.
Figure 14:
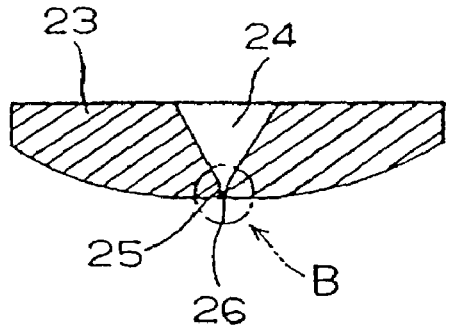
FIG. 14 is a cross sectional view viewed in an arrow direction taken along a line XIII-XIII of FIG. 12.
Figure 15:
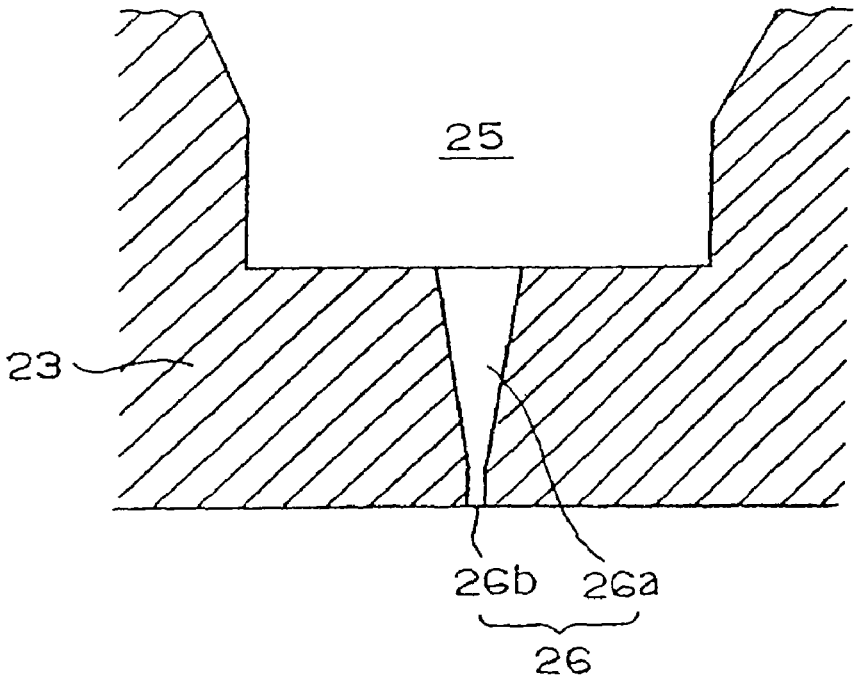
FIG. 15 is an enlarged view of an area B shown by an arrow in FIG. 14.
Figure 16:
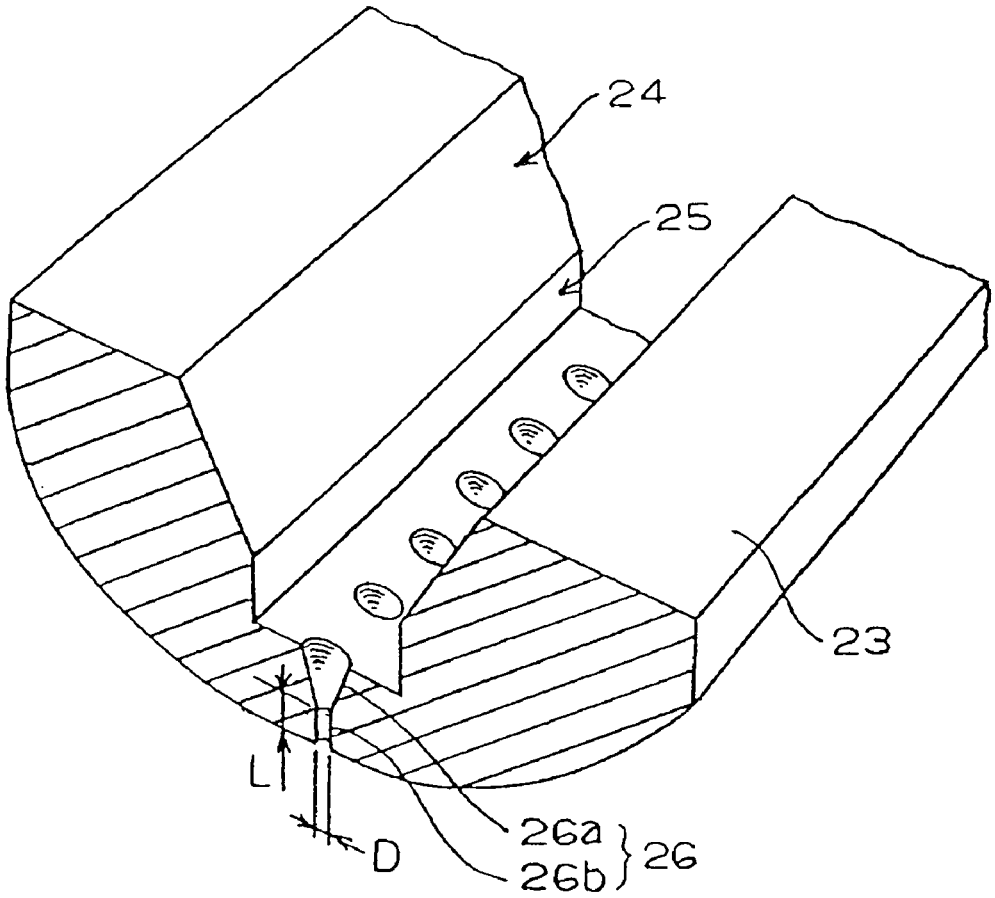
FIG. 16 is a perspective view of the essential part showing a nozzle member structure.

Although the examples with a plurality of nozzle holes 16*a* formed in the nozzle plate 16 in a row are presented in all the embodiments mentioned above, in the present invention, a plurality of the nozzle holes 16*a* formed in the nozzle plate 16 may be disposed also in two or more rows as shown in FIGS. 11A and 11B. In a case the nozzle holes 16*a* are arranged in for example two rows, it is preferable to dispose the nozzle holes 16*a* disposed between the rows to be displaced by a ½ pitch so as to be zigzag. In a case the nozzle holes 16*a* are disposed zigzag, compared with a case of a single row, even if the pitch between the nozzle holes 16*a* on a same row is made longer, the pitch is substantially made shorter as a whole so that the pressurized steam jetted from the pressurized steam jetting nozzle 10 is applied evenly in a width direction of the fiber web being transported and a moiré like pattern can hardly be formed as well.

FIGS. 12 to 16 show a second embodiment of the present invention. This embodiment differs from the embodiment including the first to fourth structure embodiments in that a nozzle member 23 does not comprise the first and second nozzle plate supporting members 15*a*, 15*b* as split pieces as in the other embodiments, but it comprises a single member such that nozzle holes 26 are formed directly in the nozzle member 23. Therefore, the nozzle plate 16 as an individual body as in the other embodiments is unnecessary.

An upper surface central part of the nozzle member 23 according to the second embodiment comprises a ship like recessed groove part 24 communicating with the slit like opening 11*b* elongating in the longitudinal direction formed in a lower surface center of the nozzle holder 11, a groove part 25 having a rectangular cross section, formed along a ship bottom part of the recessed groove part 24, a plurality of inverse truncated conical holes 26*a* formed by a predetermined pitch along the longitudinal direction of the rectangular cross section groove part 25, and cylindrical holes 26*b* formed continuously with lower ends of the inverse truncated conical holes 26*a*. The inverse truncated conical holes 26*a* and cylindrical holes 26*b* comprise the nozzle holes 26 in this embodiment. Furthermore, as to an external appearance shape of the nozzle member, it is a narrow rectangular shape in a plan view and it is a curved shape with the lower surface projected downward in a side view (see FIG. 14).

Accordingly, since the nozzle member 23 of this embodiment comprises a single member, and the nozzle member 15 is provided integrally with the nozzle plate 16 as in the embodiment as well as the nozzle member 15 is not split into the first and second nozzle plate supporting members 15*a*, 15*b*, not only a number of parts can be reduced but also troublesomeness of assembly work can be eliminated. In particular, although the nozzle holes 16*a* are formed in the nozzle plate 16 and a surface facing the fiber web is not directly a steam jetting side opening of the nozzle holes 16*a* but via the slit like opening 15*b*' formed in the second nozzle plate supporting member 15*b* according to the first embodiment, since the nozzle holes 26 can directly face the fiber web in this embodiment, a gap between the steam jetting opening end of the nozzle holes 26 and the fiber web can be set arbitrarily so that the fiber entanglement can be realized further efficiently.

Moreover, according to this embodiment, since the ship like recessed groove part 24 and the groove part 25 having the rectangular cross section formed along the ship bottom part of the recessed groove part 24 are formed in the same nozzle member 23, a pressure decline of the steam is small. Furthermore, since a side view shape of the nozzle member itself has a curved shape with the lower surface projected downward (see FIG. 14), a contact area with respect to the fiber web can be made smaller at a time of running the fiber web so that a fiber web running operation can be executed more smoothly. Moreover, also in this embodiment as in the first embodiment, the ratio value of the height of the cylindrical holes 26*b* to the inner diameter can be set preferably to 1 to 2, and the diameter of the cylindrical holes 26*b* is set at 0.1 to 1 mm, and the pitch between the nozzle holes 26 is set at 0.5 to 3 mm.

Figure 17:
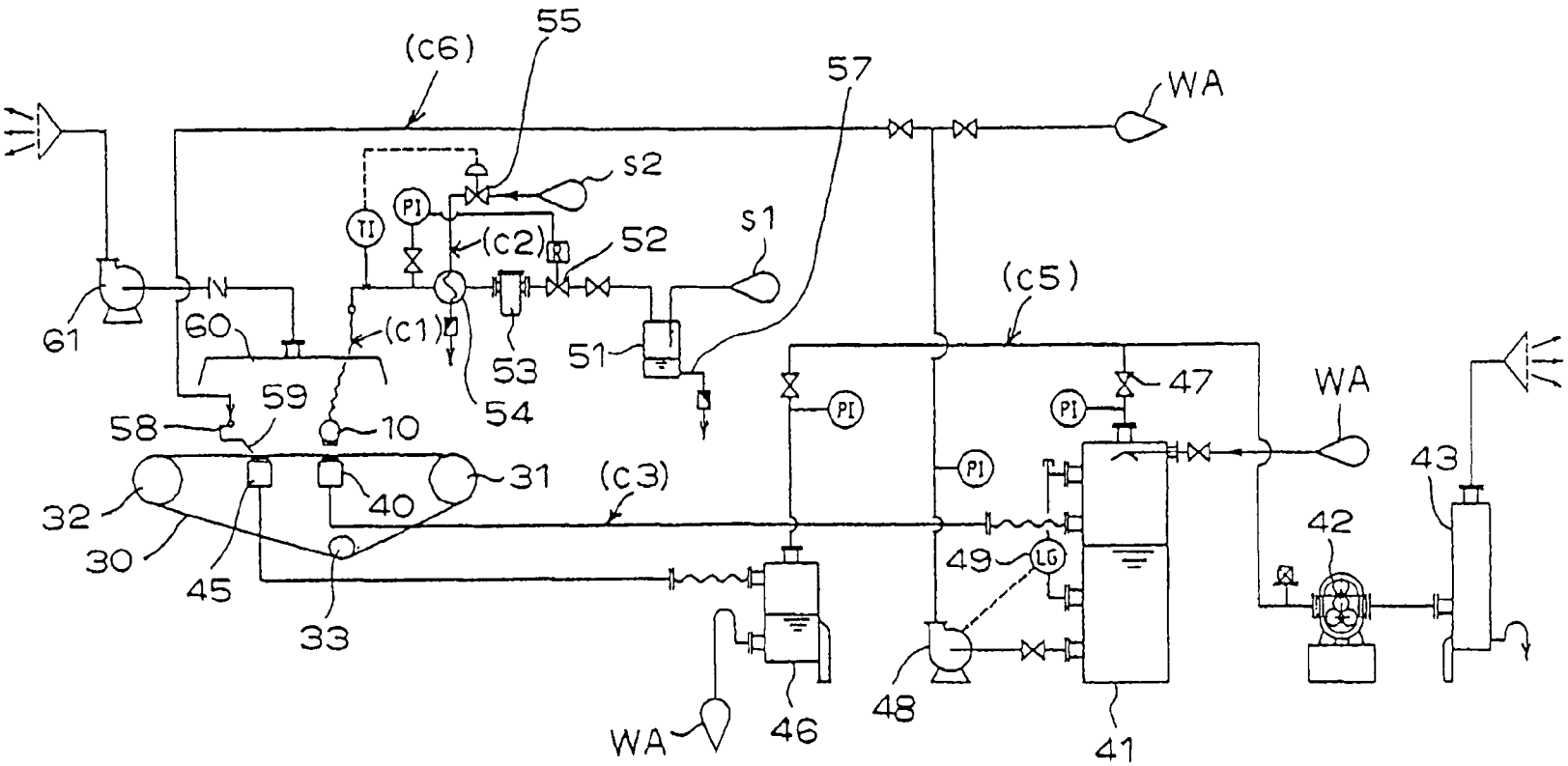
FIG. 17 is a schematic conduit explanatory diagram of a first embodiment of the production step of a nonwoven fabric according to the present invention.
Figure 18:
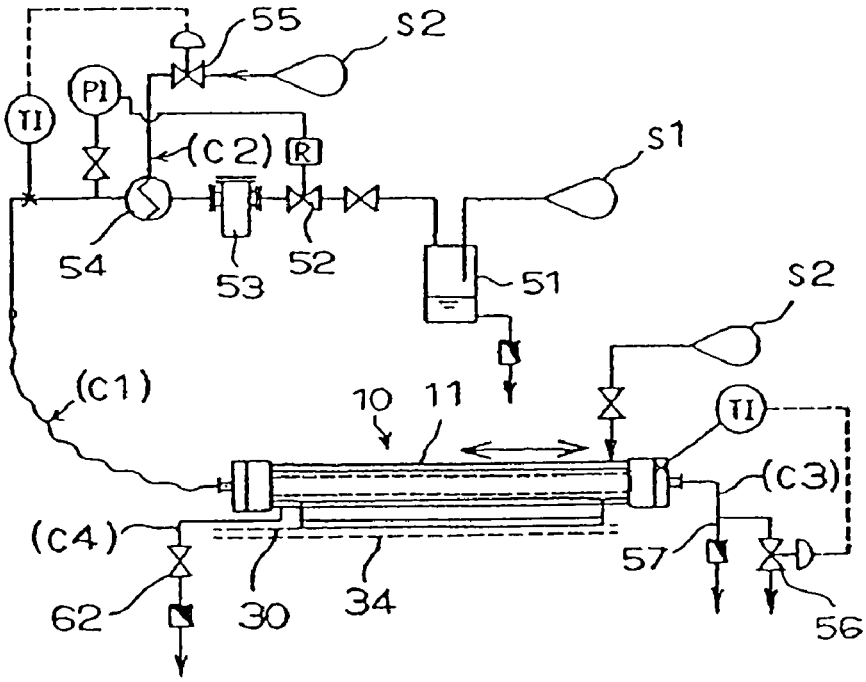
FIG. 18 is a schematic explanatory diagram of the steam conduit with respect to the pressurized steam jetting nozzle in the first embodiment.

FIGS. 17 and 18 schematically show a first embodiment of a nonwoven fabric production step according to the present invention with the pressurized steam jetting nozzles 10 applied preferably. An endless belt 30 is disposed below the pressurized steam jetting nozzle 10 by a predetermined interval. The endless belt 30 is rotated in one direction so as to traverse the pressurized steam jetting nozzle 10. Therefore, both end reversing part of the endless belt 30 are driven and supported by a driving roll 31 and a driven roll 32 to be driven by an unshown driving motor as well as they are supported by a tension roller 33 below for providing an appropriate tension to the endless belt 30. The endless belt 30 can comprise for example a mesh like woven fabric woven coarsely with a synthetic resin wide filament.

A mesh degree can be set arbitrarily. Moreover, an interval between the pressurized steam jetting nozzle 10 and the fiber web being transported on the endless belt 30 is set to 0 to 30 mm or less according to a fiber density of the fiber web and a thickness thereof. If it is more than 30 mm, a temperature and a force of the jetted steam flow are lowered. A steam pressure to be introduced into the pressurized steam jetting nozzle 10 is preferably 0.1 to 2 MPa based on a material and a fiber density of the constituent fibers of the fiber web. If the steam to be jetted from the steam jetting nozzle is provided as superheated steam, even in a case the superheated steam jetted form the nozzle holes 16*a* causes the temperature drop due to the adiabatic expansion, it cannot be fog like steam so as not to be dispersed.

Suction means is provided below with respect to the endless belt 30, corresponding to an installation portion of the pressurized steam jetting nozzle 10. According to this embodiment, the suction means comprises a suction box 40, a vacuum pump 42 interlocked with the suction box 40 by a piping via a separator tank 41, and a mist separator 43 interlocked with an outlet side of the vacuum pump 42. Here, the separator tank 41 is a gas liquid separating tank for dividing the steam vacuumed by the suction box 40 into gas and liquid, and the mist separator 43 has a function of eliminating foreign substances, hazardous gas, liquid, or the like in the steam to be discharged from the vacuum pump 42 so as to discharge the clean steam (gas) to the outside and a function as a silencer for reducing noises generated from the vacuum pump.

The pressurized steam jetting nozzle 10 comprises the structures shown in FIGS. 1 to 16 as already described, with the high pressure steam supplied from a pressurized steam supply source S1 introduced to a steam inlet side end part via a steam inlet side main conduit (c1). In the steam inlet side main conduit (c1), the steam sent in from the steam supply source S1 is temporarily guided to a steam storage part 51 for storing in a bottom part thereof drainage included in the steam and collecting the same in an unshown collecting tank via a first trap conduit 57. The steam introduced to the steam storage part 51 is heated by a heater 54 via a pressure control valve 52 and a micro filter 53 so as to become the superheated steam, and it is sent into the pressurized steam jetting nozzle 10.

According to this embodiment, as shown in FIGS. 17 and 18, a temperature sensor WI and a pressure sensor PI are disposed between the heater 54 and the steam inlet side end part of the pressurized steam jetting nozzle 10. The steam inlet side main conduit (c1) has a steam complementing conduit (c2) branched from a heater 54 installation portion, with the steam complementing conduit (c2) connected with a pressurized steam supply source S2. In a halfway of the steam complementing conduit (c2), a first opening/closing valve 55 to be driven subject to a temperature sensing signal from the heater 54 is disposed. In a case the steam temperature sensed by the temperature sensor WI is dropped to a temperature lower than a lower limit temperature, the opening/closing valve 55 is opened so that a superheated steam temperature is raised into a predetermined temperature range by new steam supplied to the steam inlet side main conduit (c1). A supply steam amount is adjusted by adjusting an opening degree of the opening/closing valve 55 such that the superheated steam temperature becomes the predetermined temperature.

The temperature of the steam as a subject can be controlled within the predetermined temperature range according to the system. Moreover, the pressure sensor PI is connected with a pressure control valve 52 disposed on an upstream side from the micro filter 53 for adjusting the steam pressure in the steam inlet side main conduit (c1) to be constant.

On the other hand, a second temperature sensor TI is disposed on the steam outlet side end part of the pressurized steam jetting nozzle 10, with the steam outlet side end part connected with a steam outlet side conduit (c3). In the steam outlet side conduit (c3), a second opening/closing valve 56 connected with the second temperature sensor TI is disposed, which is closed when the steam temperature sensed by the temperature sensor TI reaches at a set temperature. Moreover, a second trap conduit 57 is branched from a downstream side from the second opening/closing valve 56 such that the drainage generated in the inside of the nozzle holder 11 of the pressurized steam jetting nozzle 10 can always be discharged to an unshown collecting tank even if the second opening/closing valve 56 is closed so as to close the steam outlet side conduit (c3).

Furthermore, according to this embodiment, a discharging opening for steam condensed liquid is formed in a bottom surface on the pressurized steam inlet side end part of the nozzle holder 11 in FIG. 18, with an outlet opening thereof connected with a drainage conduit (c4) via a third opening/closing valve 62. At this time, the pressurized steam jetting nozzle 10 is inclined so as to lift up slightly upward an end part of the steam outlet side conduit (c3) with the pressurized steam inlet side end part thereof serving as a base end part. The pressurized steam introduced to the nozzle holder 11 is inevitably condensed and liquefied during an operation of the pressurized steam jetting nozzle 10. As it has been described already, a first nozzle plate supporting member 15*a* is fitted and fixed to a bottom surface side opening of the nozzle holder 11. Therefore, a grade difference is formed between the bottom surface of the nozzle holder 11 and the first nozzle plate supporting member 15*a* such that an upper surface of the supporting member 15*a* is made higher. Although the condensed liquid (water) produced inside the nozzle holder 11 does not reach at the nozzle plate 16 in general, if an amount of the condensed liquid is increased, it might flow into the nozzle plate 16 ahead of the grade difference. As a result, the pressurized steam cannot be jetted smoothly.

As mentioned above, by forming a discharging opening for the steam condensed liquid in the bottom surface of the pressurized steam inlet side end part of the nozzle holder 11 so as to be connected with the drainage conduit (c4) via the third opening/closing valve 62, the condensed liquid pooled in the bottom surface of the nozzle holder 11 can be discharged to the outside by opening the third opening/closing valve 62 as needed. At this time, by installing the pressurized steam inlet side end part of the nozzle holder 11 slightly lower than the end part of the steam outlet side conduit (c3) as mentioned above, since the condensed liquid pooled in the bottom surface of the nozzle holder 11 can automatically be gathered to the condensed liquid discharging opening at the pressurized steam inlet side end part, it can be discharged easily. In order to gather the condensed liquid to the bottom surface side of the nozzle holder 11 so as to smoothly flow into the pressurized steam inlet side end part, it is preferable to form a recessed groove in the bottom surface of the nozzle holder 11 along the longitudinal direction.

Furthermore, according to this embodiment, a water jetting pipe 58 for supplying water toward a surface of an unshown fiber web is installed on an upstream side in a fiber web running direction from the pressurized steam jetting nozzle 10. A guide plate 59 is disposed between the water jetting pipe 58 and the fiber web for guiding the water jetted from the water jetting pipe 58 to the fiber web surface so that the water jetted form the water jetting pipe 58 flows down as the water flow via the guide plate 59 without directly being supplied to the web surface. The water jetting pipe 58 corresponding to the pre-process means for facilitating the entanglement in the present invention has an apparent volume of the fiber web shrunk by supplying the water before receiving a shock of the pressurized steam from the pressurized steam jetting nozzle 10, and thereby a distance between the fibers in the web is shortened with each other for facilitating the entanglement of the fibers in the web with each other by the pressurized steam jetting nozzle 10. A second suction box 45 is installed also below the endless belt 30 corresponding to a guide plate 59 installation portion, with the suction box 45 connected with the vacuum pump 42 via a gas liquid separating tank 46.

A discharging opening of a top plate part of the separator tank 41 is connected with a vacuuming conduit (c5) for interlocking the gas liquid separating tank 46 and the vacuum pump 42 via the opening/closing valve 47, and a bottom part of the separator tank 41 is joined with a connecting conduit (c6) of the water jetting pipe 58 and the water supply source WA via a fluid pump 48. Moreover, a water level sensor 49 is disposed between an upper limit water level part and a lower limit water level part of the separator tank 41, and in a case a water level of the separator tank 41 becomes higher than an upper limit or lower than a lower limit, a signal thereof is sent out so as to stop an operation of the fluid pump 48 by a command of an unshown control unit.

Moreover, according to this embodiment, an opening/closing lid 60 is installed so as to wrap installation parts of the steam jetting nozzle 10 and the water jetting pipe 58. A top plate part of the opening/closing lid 60 is connected with a vacuum pump 61 so that the fog like steam generated in the installation parts of the pressurized steam jetting nozzle 10 and the water jetting pipe 58 is always vacuumed by the vacuum pump 61 so as to be discharged to the outside. According to this embodiment, although it is not shown in the figure, naturally the pressurized steam jetting nozzle 10 and its steam introducing conduit and steam outlet tube, or the like are covered with an insulation material such as a glass fiber mat with an aluminum foil excluding the steam jetting nozzle holes.

According to the production apparatus for a nonwoven fabric according to this embodiment having the above-mentioned configuration, if the high pressure superheated steam is firstly introduced from the steam inlet side main conduit (c1) by opening the second opening/closing valve 56 of the steam outlet side conduit (c3) of the pressurized steam jetting nozzle 10 prior to an operation, fresh superheated steam flows inside the nozzle holder 11 of the pressurized steam jetting nozzle 10 from the inlet side opening to the outlet side opening so as to quickly raise the temperature of the nozzle holder 11 to a predetermined heated temperature. At this time, the temperature thereof is sensed by the temperature sensor TI installed on the steam outlet side end part of the nozzle holder 11 so that an opening degree of the second opening/closing valve 56 is adjusted at a time the sensed temperature reaches at a predetermined temperature. Simultaneously with an adjustment of the opening degree of the opening/closing valve 56, the endless belt 30 is driven so as to start a rotation thereof.

According to the rotation of the endless belt 30, firstly, water is supplied to the surface of an unshown fiber web being transported on the belt by guiding the water jetted from the water jetting pipe 58 via guiding plate 59. As to a water amount at this time, since it is sufficient to wet fibers on the fiber surface for stabilizing the form thereof, a small amount will do. Moreover, as to a water supplying means, it may just jet fog like water without flowing down the water. Depending on a material of the fibers comprising the fiber web, entanglement can be executed easily, and in this case means for preliminarily facilitating the entanglement needs not be provided. On the other hand, depending on the material of the fibers comprising the fiber web, entanglement can hardly be facilitated only by supplying water. In that case, instead of supplying the water, a high pressure water flow may be jetted as conventionally disclosed in the aforementioned patent document 5. Also in this case, the water amount is not necessarily a large amount, but it may be a small amount.

Then, the columnar or converging flow superheated steam having an even pressure and temperature jetted from the nozzle holes 16*a* of the pressurized steam jetting nozzle 10 is applied to the surface of the fiber web on which the water has been supplied previously, so that a strong superheated steam flow enters into the web so as to pass through the web while entangling peripheral fibers and at the same time carrying out a thermal fusion for continuously producing a entangled fiber nonwoven fabric by the steam. At this time, the second opening/closing valve 56 installed in the steam outlet side conduit (c3) is in a closed state so that the drainage is generated inside the nozzle holder 11 of the pressurized steam jetting nozzle 10. The drainage can always be collected in the collecting tank installed outside a system via the second trap conduit 57 branched form the upstream side from the second opening/closing valve 56.

As a result, the superheated steam jetted form the nozzle holes 16*a* can be stably jetted continuously without being jetted intermittently. Accordingly, since the stable superheated steam can be jetted continuously to the surface of the running fiber web, an entire web can be entangled evenly so that an extremely high-quality nonwoven fabric having a desired strength can be produced.

Figure 19:
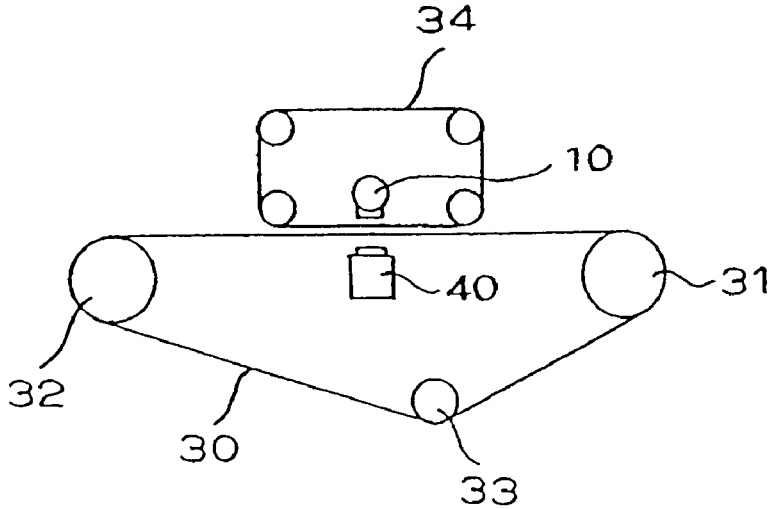
FIG. 19 is a schematic configuration explanatory diagram of a second embodiment of the production step for a nonwoven fabric according to the present invention.

FIG. 19 schematically shows a second embodiment of the production step of a nonwoven fabric according to the present invention. This embodiment differs from the first embodiment in that the means for facilitating the entanglement disposed on the upstream side from the pressurized steam jetting nozzle 10 is eliminated, and a second endless belt 34 as a fiber web pressing and transporting means of the present invention to be rotated in a same direction as the endless belt 30 is disposed in a facing state with respect to a web transporting surface of the endless belt 30 as the fiber web supporting and transporting means in the present invention so that the unshown fiber web is transported in a clamped state by the first and second endless belts 30, 34 with the superheated steam jetted form the pressurized steam jetting nozzle 10 directed from the upper surface of the fiber web to the endless belt 30 disposed below via the second endless belt 34.

Accordingly, by applying the superheated steam to the web surface while clamping the fiber web by the two endless belts 30 and 34, not only means for facilitating the entanglement prior to the superheated steam application by the pressurized steam jetting nozzle 10 as in the first embodiment is not needed any longer but also the web shape cannot be destroyed by the shock of the superheated steam jetting from the pressurized steam jetting nozzle 10. As a result, the pressure of the superheated steam jetted from the pressurized steam jetting nozzle 10 can further be made higher so as to have the pressurized steam flow jetted by a high pressure certainly passed through the fiber web. Although a void ratio (mesh degree) of the second endless belt 34 facing the upper surface of the fiber web is set coarser than that of the endless belt 30 disposed below according to this embodiment, it can be set by a same void ratio without always setting more coarsely.

Figure 20:
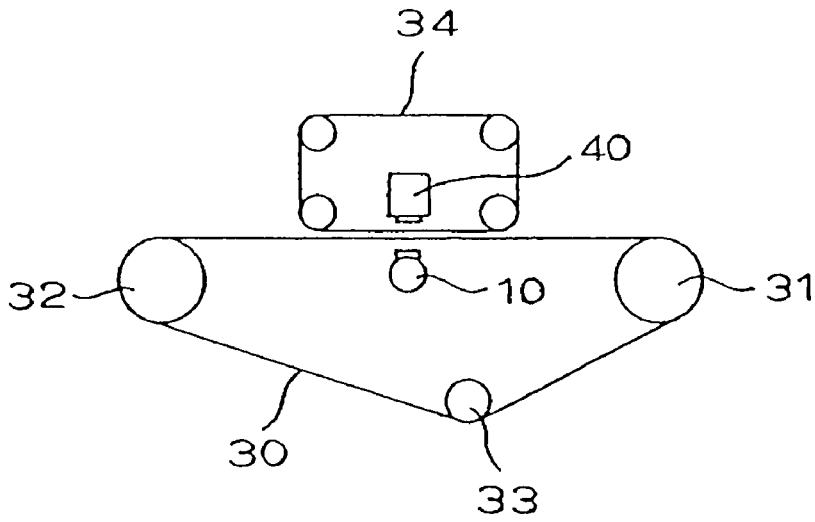
FIG. 20 is a schematic configuration explanatory diagram of a third embodiment of the production step for a nonwoven fabric according to the present invention.

FIG. 20 schematically shows a third embodiment of the production step for a nonwoven fabric according to the present invention. This embodiment differs from the second embodiment in that the installation positions of the pressurized steam jetting nozzle 10 and the suction box 40 are inverted. That is, the suction box 40 is disposed toward a rear surface of a web running side of the second endless belt 34 disposed above as well as the nozzle holes 16*a* of the pressurized steam jetting nozzle 10 are disposed toward a rear surface of a web running side of the endless belt 30 disposed below so that the high pressure superheated steam is jetted to a lower surface of an unshown fiber web running while being clamped between the endless belt 30 and the second endless belt 34 through the endless belt 30.

Accordingly, by disposing the pressurized steam jetting nozzle 10 toward the lower surface of the endless belt 30 for jetting the high pressure superheated steam to the fiber web from below, the drainage generated in the nozzle holder 11 of the pressurized steam jetting nozzle 10 is gathered to a lower surface side of the nozzle holder 11. Since only the high pressure super heated steam is always jetted from the nozzle holes 16*a* disposed on an upper surface, in addition to a function of the second embodiment, the superheated steam can be jetted not intermittently but continuously from the nozzle holes 16*a* to the fiber web, and thus a higher quality entangled fiber nonwoven fabric can be produced by steam. In this embodiment, naturally the mesh of the endless belt 30 disposed below is made coarser.

Figure 21:
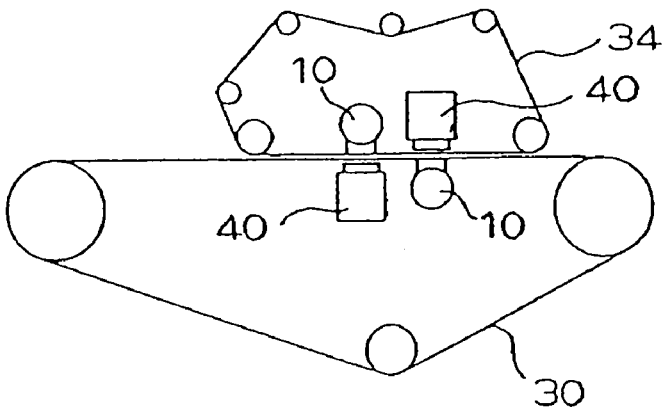
FIG. 21 is a schematic configuration explanatory diagram of a fourth embodiment of the production step for a nonwoven fabric according to the present invention.

FIG. 21 schematically shows a fourth embodiment of the production step for a nonwoven fabric according to the present invention. According to this embodiment, with the premise that the pressurized steam jetting nozzle 10 and the suction box 40 disposed facing the pressurized steam jetting nozzle 10 are provided as a pair, a plurality of the pairs (two pairs in the embodiment shown in the figure) is disposed in a fiber web transporting direction. Furthermore, arrangements of the pressurized steam jetting nozzle 10 and the suction box 40 in each pair are inverted vertically with each other. That is, the pressurized steam jetting nozzle 10 is disposed with the nozzle holes 16*a* of the pressurized steam jetting nozzle 10 of a first pair facing toward the upper surface of the second endless belt 34 running together while pressing the upper surface of the fiber web, and the suction box 40 is disposed with a vacuuming opening facing toward the lower surface of the first endless belt 30 transporting the fiber web while supporting the fiber web from below. On the other hand, the pressurized steam jetting nozzle 10 of a second pair is disposed with its nozzle holes 16*a* facing toward the lower surface of the first endless belt 30 transporting the fiber web while supporting the same from below, and the suction box 40 is disposed with its vacuuming opening facing toward the upper surface of the second endless belt 34 running together while pressing the same from above.

Accordingly, by jetting the high pressure superheated steam from the pressurized steam jetting nozzles alternately to the upper surface and the lower surface of the fiber web being transported while being clamped by the first and second endless belts 30, 34, the high pressure superheated steam functions evenly to the front and rear surfaces of the fiber web so that the constituent fibers are entangled evenly in the front and rear surfaces of the nonwoven fabric to be produced so as to easily ensure a shape stability as the nonwoven fabric, and furthermore, as to an external appearance, the front and rear sides can be provided indistinctive so as to improve a product value.

Figure 22:
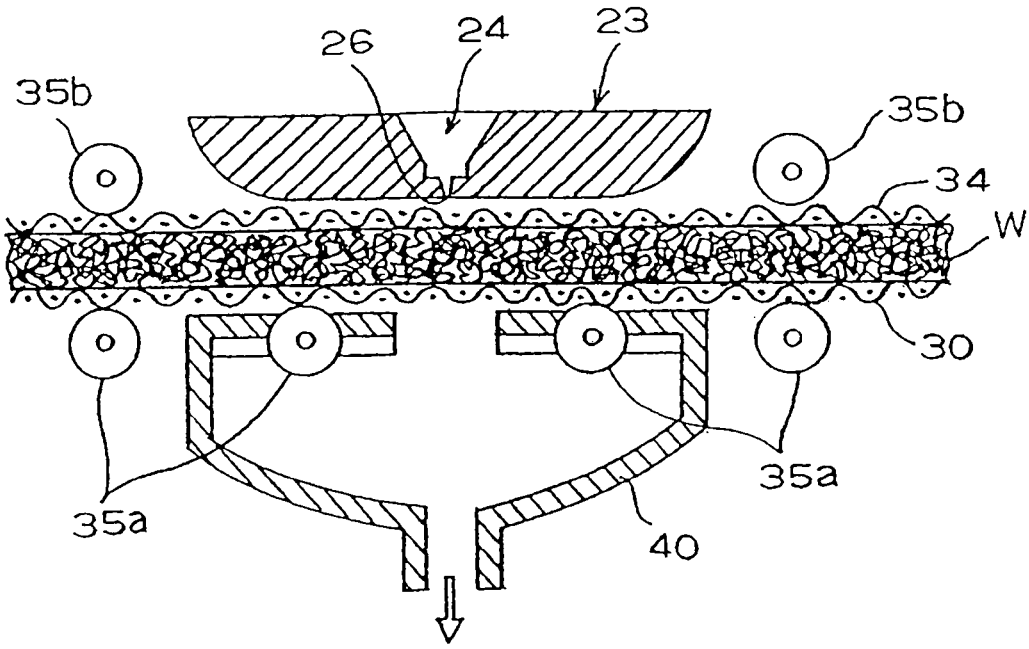
FIG. 22 is a schematic configuration explanatory diagram of the essential part of a most preferable fourth embodiment of the production step for a nonwoven fabric according to the present invention.

FIG. 22 schematically shows an essential part of a most preferable fourth embodiment of the production process for a nonwoven fabric according to the present invention. Numeral 23 in the figure denotes the nozzle member of the high pressure steam jetting nozzle shown in FIGS. 11 to 16. The endless belt 34 as the fiber web pressing and transporting means is disposed adjacently to a lower surface of the nozzle member 23. The fiber web W transported while being supported by the first endless belt 30 as the fiber web supporting and transporting means is transported by a cooperation by clamping the same by the endless belt 34. During the clamping transportation, the high pressure superheated steam is jetted to the fiber web surface via the nozzle holes 26 of the nozzle member 23. The suction box 40 as the vacuuming means is disposed adjacently to the lower surface of the first endless belt 30.

In this embodiment, the vacuuming opening of the suction box 40 is disposed at a position facing the nozzle holes 26 of the nozzle member 23, and a shape is like a slit so as to avoid vacuuming peripheral gas as much as possible. An opening width of this slit opening is preferably about 10 mm. As to a vacuuming force thereof, an exhausting ability of a ventilation fan used in an ordinary factory, that is, about 300 Pa is sufficient. In a case it is larger than that, it may easily provide an orientation to the constituent fibers of the fiber web, and in a case it is smaller, the vacuuming force is insufficient. Of course the vacuuming force needs to be adjusted in a desired range depending on a thickness of the fiber web, a density and the steam pressure at a time of jetting from the nozzle member 23.

Moreover, in this embodiment, a plurality of supporting rotary rolls 35*a* for supporting and guiding the lower surface of the first endless belt 30 and a plurality of limiting guiding rolls 35*b* for limiting and guiding an upper surface position of the second endless belt 34 are provided so as to maintain a gap between the nozzle member 23 and the second endless belt 34 and a gap between the first endless belt 30 and the suction box 40. By providing the supporting rotary rolls 35*a* and the limiting guiding rolls 35*b*, not only the fiber web W can be clamped and transported with an appropriate clamping force by the first and second endless belts 30, 34 but also sliding contact of the endless belts 30, 34, and the nozzle member 23 and the suction box 40 can be avoided, and at the same time a facing gap can be maintained minutely. The supporting rotary rolls 35*a* and the limiting guiding rolls 35*b* can be provided each adjustably by known vertical direction adjusting means.

Figure 23:
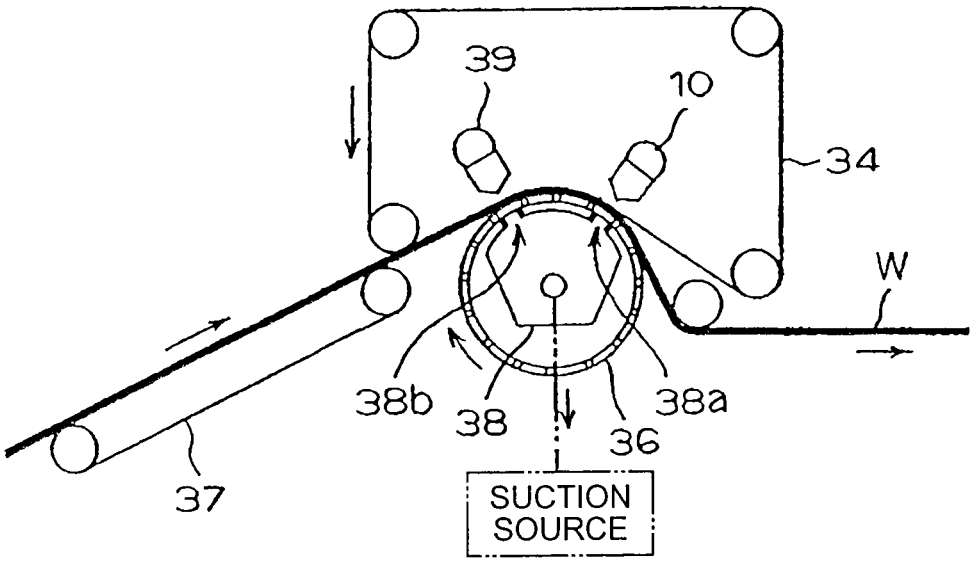
FIG. 23 is a schematic configuration explanatory diagram of a fifth embodiment of the production step for a nonwoven fabric according to the present invention.

FIG. 23 schematically shows a fifth embodiment of the production step for a nonwoven fabric according to the present invention. In this embodiment, a porous rotary drum 36 is adopted as the supporting and transporting means for the fiber web W. As the fiber web pressing and transporting means, as in the embodiment, a porous endless belt 34 is used.

The endless belt 34 is disposed above the rotary drum 36 so as to be placed around a circumferential surface in a desired central angle area of the rotary drum 36 disposed below. At this time, the endless belt 34 and the rotary drum 36 are driven and rotated synchronously in the opposite directions. The fiber web W is introduced between the endless belt 34 and rotary drum 36 via an endless belt 37 or an unshown guide plate or a guide roll so that the fiber web W is clamped between the endless belt 34 and the rotary drum 36 so as to be sent out to an outlet side while moving around the circumferential surface of the rotary drum 36 corresponding to the central angle.

On the other hand, the high pressure high temperature steam jetted from the pressurized steam jetting nozzle 10 installed inside the endless belt 34 enters the fiber web W clamped and transported between the endless belt 34 and rotary drum 36 so as to pass through the fiber web W while entangling the constituent fibers of the fiber web W and goes outside via the suction box 38 installed inside the rotary drum 36. The suction box 38 has a vacuuming opening 38*a* in a slit like shape having a same size as a fiber web W width and extending in a width direction so as to vacuum efficiently. A width size of the vacuuming opening 38*a* is preferably about 10 mm as in the fourth embodiment described already, however, modification can be applied to some extent depending on the thickness of the fiber web, the density, its material, or the like. The vacuuming opening 38*a* of the suction box 38 is fixed at a position facing the nozzle holes 16*a*, 26 of the pressurized steam jetting nozzle 10 and adjacently to an inner wall surface of the rotary drum 36 so that the vacuumed steam is discharged to the outside through a discharge path formed in a central part of a rotation axis of the rotary drum 36 via an unshown swivel joint.

According to this embodiment, a jetting device 39 for pressurized high temperature air is further installed inside the endless belt 34 on an upstream side from the pressurized steam jetting nozzle 10 as well as a second vacuuming opening 38*b* is formed at a portion corresponding to the jetting device 39 of the pressurized high temperature air on an upstream side from a vacuuming opening 38*a* of the suction box 38 disposed inside the rotary drum 36. A shape and a size of the vacuuming opening 38*b* are substantially same as those of the vacuuming opening 38*a*, however, a jetting pressure of the high temperature pressurized air jetted therefrom may be set smaller than a jetting pressure from the pressurized steam jetting nozzle 10. Moreover, a size of unshown nozzle holes needs not be set strictly.

This is because unlike the pressurized steam application, pressurized air is applied to the fiber web W for a purpose of temporarily ensuring a surface form of the fiber web W by entangling the constituent fibers in a vicinity of the surface of the fiber web W by applying the pressurized air prior to the steam application. By for example mixing a low melting point fiber partially in the constituent fibers of the fiber web W, the surface form of the fiber web W can be stabilized also by fusing peripheral fibers by melting the low melting point fiber utilizing the jetting device 39 for the pressurized high temperature air. As the nozzle member used in this embodiment, the nozzle members shown in FIGS. 1 to 16 may be adopted as well. Moreover, as to a steam circuit for the pressurized steam jetting nozzle 10 in this embodiment, circuits shown as examples in FIGS. 17 and 18 can be adopted.

Figure 24:
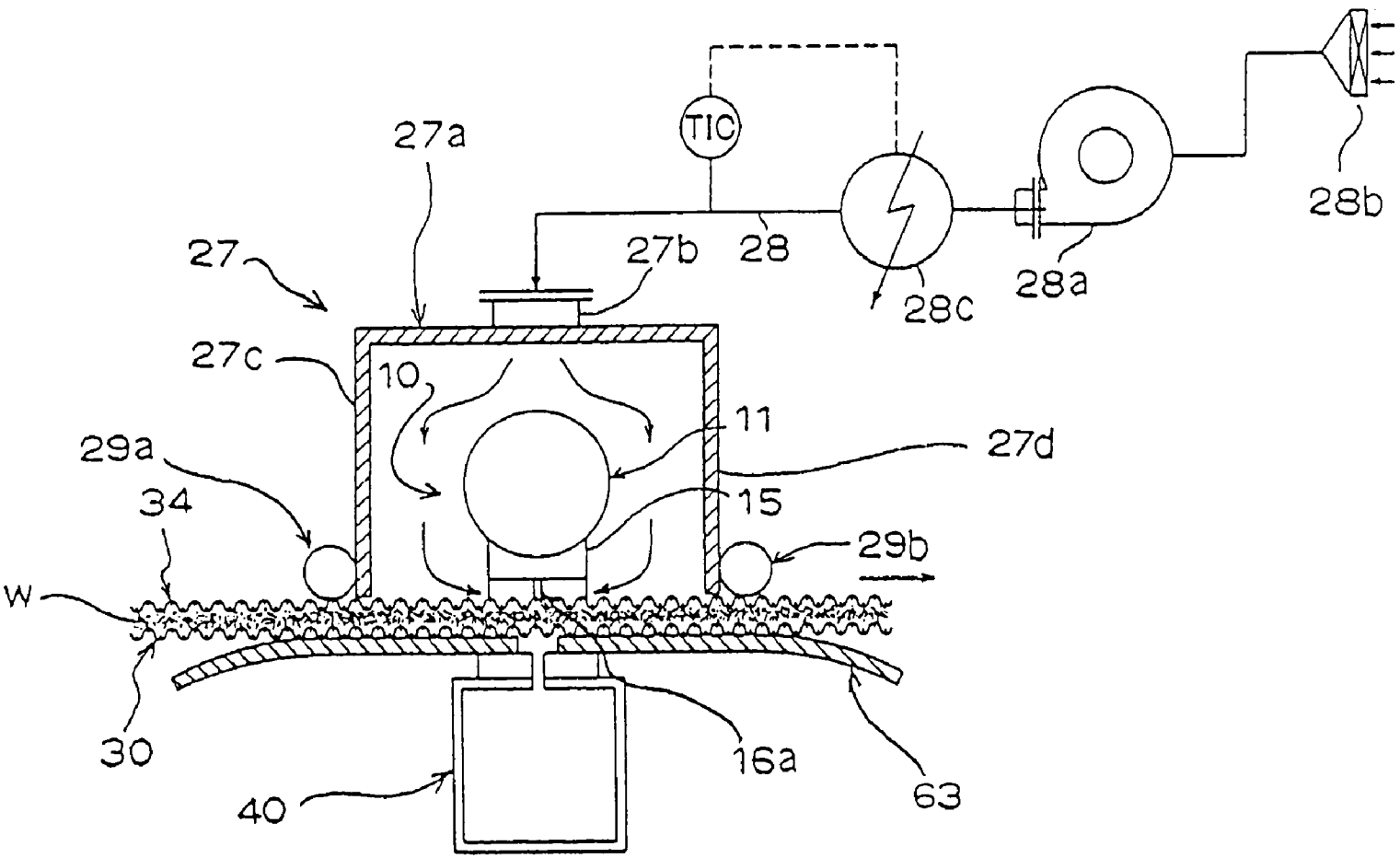
FIG. 24 is a vertical cross sectional view showing an embodiment of a heating part of the pressurized steam jetting nozzle of the present invention.

Although the nozzle holes 16*a* of the pressurized steam jetting nozzle 10 having a above-mentioned structure are disposed simply toward the supporting and transporting means and/or the pressing and transporting means for the fiber web according to the embodiment, it is also possible to actively heat an entirety of the pressurized steam jetting nozzle 10 for maintaining the high temperature. FIG. 24 shows an example thereof. According to the figure, a heating box 27 for storing the entirety of the pressurized steam jetting nozzle 10 comprising the nozzle holder 11, the nozzle plate supporting member 15 and the nozzle plate 16 is used. The heating box 27 comprises a narrow rectangular parallelepiped storing the entirety of the pressurized steam jetting nozzle 10 with a side having the nozzle holes 16*a* of the pressurized steam jetting nozzle 10 oriented opened by an entire surface, and a hot air inlet opening 27*b* formed in a central part of the top plate part 27*a* thereof. The hot air inlet opening 27*b* is connected with a hot air supply conduit 28 of the outside. High temperature purified air introduced by a fan 28*a* via a filter 28*b* and heated by a heater 28*c* is sent into the heating box 27 through the hot air supply conduit 28 for actively heating the entirety of the pressurized steam jetting nozzle 10 by the hot air.

By accordingly heating the entirety of the pressurized steam jetting nozzle 10, the temperature drop of the pressurized steam or the superheated steam to be introduced to the inside of the nozzle holder 11 can be prevented effectively so that it can be jetted from the pressurized steam jetting nozzle 10 toward the fiber web W while maintaining the desired temperature. As a result not only the efficient fiber entanglement can be realized but also the shape of the nonwoven fabric to be produced can be stabilized so as to obtain a desired strength and feeling.

Moreover, according to the example shown in the figure, the lower end part of the front and rear wall surfaces 27*c*, 27*d* in the fiber web transporting direction of the heating box 27 is contacted with circumferential surfaces of seal rolls 29*a*, 29*b*. The seal rolls 29*a*, 29*b* are a stainless steel smooth roll or a roll with the circumferential surface coated with a resin, or the like, and they may be a free rotary roll or they may be driven and rotated synchronously with a transporting speed of the fiber web W. By disposing the seal rolls 29*a*, 29*b*, dispersion of the hot air from the heating box 27 can be prevented as well as an introduction of external air can be prevented so that a heating efficiency for the pressurized steam jetting nozzle 10 can be improved.

Moreover, in this example, an external air blocking plate 63 with a part corresponding to the vacuuming opening part of the suction box 40 disposed to face the first endless belt 30 as the fiber web W supporting and transporting member opened is further provided between the first endless belt 30 and suction box 40. By curving downward front and rear end parts in a fiber web transporting direction of the external air blocking plate 63 respectively, passage of the fiber web W is stabilized smoothly. By accordingly providing the external air blocking plate 63 between the first endless belt 30 and the suction box 40, entrance of the external air to a jetting area of the pressurized steam or the superheated steam jetted from the pressurized steam jetting nozzle 10 can be prevented so that the jetted pressurized steam or superheated steam can be applied efficiently to the fiber web W. As a result, the surface form of the nonwoven fabric to be produced can further be homogenized as well as the fiber entanglement can be executed densely.

Figure 25:
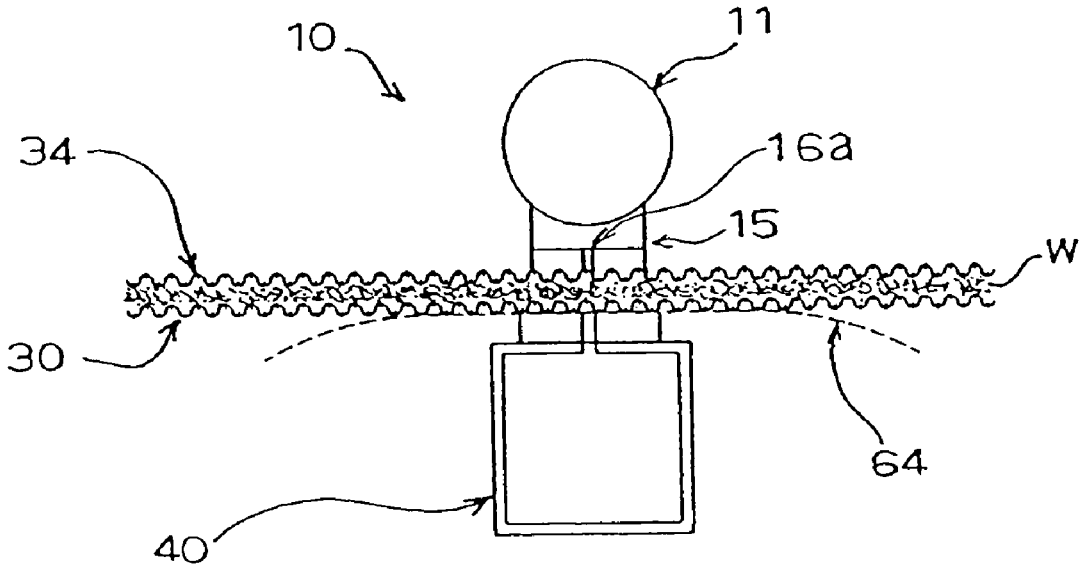
FIG. 25 is a vertical cross sectional view showing an embodiment having a steam reflecting plate disposed between the fiber web and the vacuuming means of the present invention.

FIG. 25 shows a further modified embodiment of the apparatus of the present invention. According to the modified embodiment, as in a case of the external air blocking plate 63, a steam reflecting plate 64 is provided between the first endless belt 30 and the suction box 40. The steam reflecting plate 64 and the external air blocking plate 63 differ in that the external air blocking plate 63 is formed in a smooth surface excluding the opening elongating in a row direction of the nozzle holes 16*a* in the center but the steam reflecting plate 64 comprises a porous plate member. In a case the pressurized steam or the superheated steam jetted form the pressurized steam jetting nozzle 10 passes through the second endless belt 34, the fiber web W and the first endless belt 30 now, although a part of the steam is vacuumed by the suction box 40, most of that is reflected by the steam reflecting plate 64 so as to function again on the lower surface of the fiber web W so as to push the constituent fibers and the peripheral fibers into the web and entangle the same at a same time. As a result, an entangling ratio of the constituent fibers on the lower side of the fiber web W is increased so as to achieve a high quality in terms of the external appearance and the strength.

Furthermore, according to the present invention, as shown by the arrow in FIG. 18, the pressurized steam jetting nozzle 10 may be moved minutely reciprocally in its longitudinal direction, or the first and second endless belts 30, 34 may be moved minutely reciprocally in a direction traversing the fiber web transporting path together with the fiber web. Although it is not shown in the figure, as a driving mechanism for a reciprocal movement, for example a conventionally known structure for applying a lateral vibration to a mesh of a Fourdrinier paper machine, or the like can be used. Moreover, a stroke of the reciprocal movement (vibration) is preferably about 5 mm to right and left sides from a reciprocal movement center, and a number of the reciprocal movements can be adjusted optionally in a range of 30 to 300 times/minute. Accordingly, by reciprocally moving the pressurized steam jetting nozzle 10, or the first and second endless belts 30, 34, the pressurized steam or the superheated steam jetted form a plurality of the nozzle holes disposed in rows can function evenly on the surface of the fiber web in the width direction so that the evener fiber entanglement and the surface form can be obtained without applying the moiré like pattern on the surface.

As heretofore explained, according to the method and the apparatus of the present invention, not only the high pressure high temperature steam can pass through the fiber web further certainly by the pressurized steam jetting nozzle having a simple structure but also a preparation time at a time of starting a production of the nonwoven fabric can be shortened drastically by preliminarily opening the opening/closing valve at a time of starting the production of the nonwoven fabric, introducing the fresh pressurized steam to the pressurized steam jetting nozzle and discharging the same from the opening on the steam outlet side opening to the outside so as to drastically raise the internal temperature of the nozzle holder by the pressurized steam in a case both ends in the longitudinal direction of the nozzle holder are opened and particularly the opening on the steam outlet side is provided switchably by the opening/closing valve 56 (FIG. 18) as well as the trap conduit is branched on the upstream side from the opening/closing valve.

Although the opening/closing valve 56 is closed at the time the production of the nonwoven fabric is started, since the drainage generated inside the nozzle holder is always collected in the collecting tank from the opening on the steam outlet side via the trap conduit, the high quality nonwoven fabric can be produced continuously and stably. Although the superheated steam is used as the steam in the embodiment, ordinary steam can also be used depending on a material of the constituent fibers of the fiber web.

The invention claimed is:

1. A pressurized steam jetting nozzle comprising a tubular nozzle holder having on one end a pressurized steam inlet opening to be connected with a pressurized steam supply tube, on another end a steam outlet opening to be connected with a steam discharge tube of an outside, and an opening elongating along a longitudinal direction of a lower surface thereof, and a nozzle member disposed detachably on the lower surface of the nozzle holder and having a plurality of nozzle holes formed so as to face the opening.

2. The pressurized steam jetting nozzle according to claim 1, wherein the tubular nozzle holder is a cylindrical nozzle holder.

3. The pressurized steam jetting nozzle according to claim 1, wherein a cylindrical filter capable of eliminating minute foreign substances included when steam is introduced is disposed on a same axis as that of an inside of the nozzle holder.

4. The pressurized steam jetting nozzle according to claim 1, wherein the opening formed in the lower surface of the nozzle holder is a slit like opening formed continuously in a longitudinal direction of the nozzle holder.

5. The pressurized steam jetting nozzle according to claim 1, wherein the opening formed in the lower surface of the nozzle holder comprises small holes formed zigzag in a longitudinal direction of the nozzle holder.

6. The pressurized steam jetting nozzle according to claim 1, wherein the nozzle holder has a drainage outlet opening in a lower part thereof.

7. The pressurized steam jetting nozzle according to claim 1, wherein the nozzle holder has a drainage outlet opening on one end thereof, and the nozzle holder is inclined upward with respect to a horizontal line with a drainage opening side end part provided as a base end.

8. The pressurized steam jetting nozzle according to claim 1, wherein the nozzle member comprises a nozzle plate having a plurality of nozzle holes and a plate supporting member for supporting the nozzle plate, and the nozzle holes have tubular holes.

9. The pressurized steam jetting nozzle according to claim 8, wherein the nozzle holes are disposed in a plurality of rows in a width direction of the nozzle plate.

10. The pressurized steam jetting nozzle according to claim 8, wherein a shape of each of the tubular holes is cylindrical.

11. The pressurized steam jetting nozzle according to claim 8, further comprising a continuous groove part having an inverse trapezoidal cross section continuous in a longitudinal direction of the nozzle plate in an upper end of the tubular hole of each of the nozzle holes.

12. The pressurized steam jetting nozzle according to claim 8, further comprising an inverse truncated conical hole on an upper end of the tubular hole having a cylindrical shape.

13. The pressurized steam jetting nozzle according to claim 10, wherein a value of a ratio of a tubular hole height to an inner diameter is set at 1 to 2.

14. The pressurized steam jetting nozzle according to claim 8, wherein each of the nozzle holes has a ring piece elongating concentrically from a lower end circumferential rim of each of the tubular holes into a hole opening.

15. The pressurized steam jetting nozzle according to claim 8, wherein a plate thickness of the nozzle plate is 0.5 to 1 mm.

16. The pressurized steam jetting nozzle according to claim 15, wherein a steam jetting opening inner diameter of each nozzle hole is 0.05 to 1 mm, and a pitch between nozzles is 0.5 to 3 mm.

17. The pressurized steam jetting nozzle according to claim 1, wherein the nozzle member comprises a single member having a ship like recessed groove part communicating with a lower end opening of the nozzle holder, a rectangular cross section groove part formed along a ship bottom part of the recessed groove part, a plurality of inverse truncated conical holes formed by a predetermined pitch along a longitudinal direction of the rectangular cross section groove part, and cylindrical holes formed continuously on lower ends of the inverse truncated conical holes.

18. The pressurized steam jetting nozzle according to claim 17, wherein a lower end face shape in a width direction of the nozzle member is provided as a curved surface shape projecting downward.

19. The pressurized steam jetting nozzle according to claim 17, wherein a value of a ratio of a cylindrical tubular hole height to an inner diameter is set at 1 to 2.

20. The pressurized steam jetting nozzle according to claim 18, wherein a steam jetting opening inner diameter of a nozzle hole is 0.05 to 1 mm, and a pitch between nozzles is 0.5 to 3 mm.

* * * * *